US012000155B2

(12) United States Patent
De Rick et al.

(10) Patent No.: US 12,000,155 B2
(45) Date of Patent: Jun. 4, 2024

(54) FLOOR OR WALL COVERING

(71) Applicant: FLOORING INDUSTRIES LIMITED, SARL, Bertrange (LU)

(72) Inventors: Jan De Rick, Geraardsbergen (BE); Bryan Rollier, Kanegem (BE)

(73) Assignee: UNILIN BV, Wielsbeke (BE)

( * ) Notice: Subject to any disclaimer, the term of this patent is extended or adjusted under 35 U.S.C. 154(b) by 81 days.

(21) Appl. No.: 17/641,003

(22) PCT Filed: Sep. 8, 2020

(86) PCT No.: PCT/IB2020/058328
§ 371 (c)(1),
(2) Date: Mar. 7, 2022

(87) PCT Pub. No.: WO2021/059062
PCT Pub. Date: Apr. 1, 2021

(65) Prior Publication Data

US 2022/0341185 A1 Oct. 27, 2022

Related U.S. Application Data

(60) Provisional application No. 63/042,789, filed on Jun. 23, 2020, provisional application No. 63/024,794, filed on May 14, 2020, provisional application No. 62/971,401, filed on Feb. 7, 2020, provisional application No. 62/958,082, filed on Jan. 7, 2020, provisional application No. 62/942,335, filed on Dec.
(Continued)

(51) Int. Cl.
*E04F 15/02* (2006.01)

(52) U.S. Cl.
CPC .. *E04F 15/02016* (2013.01); *E04F 15/02033* (2013.01); *E04F 2201/0146* (2013.01)

(58) Field of Classification Search
CPC ..... E04F 15/02016; E04F 15/02033; E04F 2201/0146
USPC ..... 52/272, 588.1, 589.1, 592.1
See application file for complete search history.

(56) References Cited

U.S. PATENT DOCUMENTS 1,832,397 A * 11/1931 Hultquist ..... E04F 13/08 52/432
6,363,677 B1 * 4/2002 Chen ..... E04F 15/02016 52/471
(Continued)

FOREIGN PATENT DOCUMENTS

BE 1018480 A3 1/2011
CN 1812873 A 8/2006
(Continued)

OTHER PUBLICATIONS

International Search Report with Written Opinion from PCT Application No. PCT/IB2020/058328, dated Feb. 17, 2021.

*Primary Examiner* — Brent W Herring
(74) *Attorney, Agent, or Firm* — Workman Nydegger

(57) ABSTRACT

A recess is provided at the surface of a floor or wall covering between two panels mechanically coupled to each other by a male coupling part and a female coupling part. The recess may include a first recess cut out or otherwise provided at the female edge through the top layer and extending into the substrate. The recess may have a second recess cut out or otherwise provided at the male edge through the top layer and extending into the substrate. The recess includes a grouting material.

18 Claims, 18 Drawing Sheets

Related U.S. Application Data

2, 2019, provisional application No. 62/904,193, filed on Sep. 23, 2019.

(56) References Cited

U.S. PATENT DOCUMENTS 7,802,415 B2 * 9/2010 Pervan ..... E04F 15/04 52/390
7,975,451 B2 * 7/2011 Leopolder ..... E04F 13/0889 52/592.1
7,993,731 B2 8/2011 Miller et al.
8,341,904 B2 * 1/2013 Galas ..... E04F 19/0463 52/287.1
8,689,513 B2 * 4/2014 Windmoller ..... E04F 15/105 52/588.1
8,833,028 B2 * 9/2014 Whispell ..... B32B 5/245 52/592.1
9,151,062 B2 10/2015 Cappelle et al.
9,290,951 B2 3/2016 Moriau et al.
9,611,654 B2 4/2017 Dao et al.
9,611,659 B2 4/2017 Baert et al.
9,970,198 B2 5/2018 Thiers
10,132,088 B2 * 11/2018 Courey ..... E04F 15/02033
10,233,656 B2 * 3/2019 Courey ..... B32B 27/304
2003/0024199 A1 * 2/2003 Pervan ..... E04F 15/02011 52/592.1
2004/0146695 A1 7/2004 Hardwick
2004/0182036 A1 * 9/2004 Sjoberg ..... E04F 15/02016 52/592.1
2007/0175144 A1 * 8/2007 Hakansson ..... B44C 5/0492 52/403.1
2009/0038254 A1 * 2/2009 Steele ..... E04F 15/02 52/745.05
2010/0018149 A1 1/2010 Thiers
2011/0146188 A1 * 6/2011 Wallin ..... E04F 15/02033 29/897.32
2011/0167744 A1 * 7/2011 Whispell ..... E04F 15/105 52/309.1
2012/0192521 A1 * 8/2012 Schulte ..... E04F 13/08 52/588.1
2012/0240502 A1 * 9/2012 Wilson ..... E04F 15/14 52/416
2012/0266555 A1 10/2012 Cappelle
2013/0036695 A1 * 2/2013 Durnberger ..... E04F 15/02038 52/309.3
2013/0104486 A1 * 5/2013 Windmoller ..... E04F 15/107 29/428
2013/0111843 A1 5/2013 Litral
2013/0160390 A1 * 6/2013 Stockl ..... E04F 15/02 52/588.1
2015/0252561 A1 * 9/2015 Johnson ..... E04F 19/045 52/272
2018/0298621 A1 * 10/2018 Courey ..... B32B 3/06
2018/0298622 A1 * 10/2018 Courey ..... E04F 15/107
2019/0071879 A1 3/2019 Thiers et al.
2020/0056380 A1 * 2/2020 Dai ..... B32B 27/08
2021/0198901 A1 * 7/2021 Josefsson ..... E04F 15/107

FOREIGN PATENT DOCUMENTS

CN 102051973 A 5/2011
CN 102605926 A 7/2012
CN 103797198 A 5/2014
JP 2004502890 A 1/2004
NL 2013046 B1 7/2016
WO 2008/053333 A2 5/2008
WO 2017/013501 A1 1/2017

* cited by examiner

FLOOR OR WALL COVERING

BACKGROUND

The invention relates to floor and wall coverings comprising panels that are mechanically coupled to each other. Panels exist that are made out of water resistant material. However, after mechanical coupling it could still be possible that water can penetrate via the panel joints.

Stone Plastic Composite (SPC) tiles or Wood Plastic Composite (WPC) tiles exist that imitate ceramic, marble or natural stone tiles. US2004/0146695A1 discloses vinyl tiles which are individually cut, routed and mechanically embossed on two adjacent edges to give the appearance, when installed, that each individual tile has grout lines on all of the edges.

US2013/111843 discloses surface covering tiles made using synthetic materials. The tiles have junction strips which enable the tiles to be connected to one another. The connections can be made with or without adhesive. When the tiles are connected, a space is left between adjacent decorative surfaces to permit the application of grout or simulated grout therein. When the tiles are used as floor covering, they can be used to make floating floors.

US 2012/0240502 discloses a vinyl-based floor tile for constructing a floating and groutable floor covering. The vinyl-based floor tile has a decorative upper surface and a lower surface for supporting the floor tile. The edges of the floor tile are provided with male and female coupling members. After coupling the edges of the floor tiles, a grout-accepting surface is provided on the top surface of one of the coupling members. The decorative upper surface of the tile can have a removable protective layer that protects the vinyl tile during the installation and grouting process.

SUMMARY

It is an objective of the invention to provide floor and wall coverings comprising mechanically coupled floor or wall panels wherein no water can penetrate through the panel joints; and that have a high strength of the coupling. To this end, the invention has several independent aspects.

The inventive aspects are described by the independent claims. Preferred embodiments are described in the independent claims.

The first aspect of the invention is a floor or wall covering comprising floor or wall panels. Preferably the floor coverings according to the invention comprises floor panels, and the wall coverings comprise wall panels. The floor or wall panels comprise a substrate and a top layer. The top layer comprises a decor layer; and optionally a wear layer. Preferably, the decor layer is wear resistant and decorative, preferably to imitate ceramic, stone, marble or other material. Optionally, the substrate comprises a plurality of layers. The floor or wall panels are provided at least at the edges of two opposite sides with coupling parts, cooperating which each other, substantially in the form of male coupling parts and female coupling parts, for coupling the floor or wall panels to each other in the floor or wall covering. The male coupling part is provided at the male edge of the floor or wall panels. The female coupling part is provided at the female edge of the floor or wall panels. Optionally, the coupling parts are provided with integrated mechanical locking means which prevent the drifting apart of two coupled floor or wall panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part. Optionally, the recess comprises a first recess cut out or otherwise provided at the female edge, preferably through the top layer and preferably extending into the substrate. Optionally, the recess comprises a second recess cut out or otherwise provided at the male edge, preferably through the top layer and preferably extending into the substrate. The recess comprises a grouting material. Preferably, the recess is filled with a grouting material.

The floor or wall covering comprises optionally one or a combination (in so far as the combination is not contradictory) of the following aspects I-VI:

I: The grout is provided on a surface of the male coupling edge substantially parallel with the panel surface as well as on a surface of the female coupling edge substantially parallel with the panel surface. Preferably, these surfaces substantially parallel with the panel surfaces are provided at the bottom of the recess. In the case of floor panels, the surface of the male coupling edge substantially parallel with the panel surface is a substantially horizontal surface and the surface of the female coupling edge substantially parallel with the panel surface is a substantially horizontal surface.

II: The recess comprises or consists of the shape of a trapezium with the two parallel sides of the trapezium provided parallel with the floor or wall panels; and with the longest side of the two parallel sides closer to the surface level of the floor or wall panels than the shortest side of the two parallel sides. The longest side of the two parallel sides is preferably provided at the surface level of the panels. Preferably, the two inclined sides of the trapezium intersect with the top surface of the panel.

III. The recess comprises a surface of the male edge and/or of the female edge having an included angle with the top surface of the panel to which the edge belongs that is less than 90°, preferably less than 85°, and preferably more than 70°. Preferably the surface of the male edge and/or the surface of the female edge intersects with the top surface of the panel on which it is provided.

IV: Below the recess a narrow gap is provided in the substrate between the male edge and the female edge. Grout is provided in this narrow gap. Preferably, the narrow gap is provided between sections of the male edge and of the female edge perpendicular to the surface of the panel; preferably the narrow gap is less than 0.5 mm wide. These sections perpendicular to the surface of the panel are vertical sections in the case of floor panels.

V: At least one of the female edge or the male edge comprises a protrusion, preferably directed substantially downwards when the panel is put horizontally. The protrusion, preferably directed substantially downwards, is preferably provided by removal of material at the bottom of the panel or otherwise provided, e.g. by extrusion. The protrusion, preferably directed substantially downwards, makes contact with an element of the other edge (preferably the protrusion makes contact with the distal end of the other edge) thereby locking the panels horizontally in a flexible way. Preferably, the lower end of the protrusion does not extend beyond the bottom of the panel. Preferably the lower end of the protrusion is provided at the same level as the bottom of the panels.

VI: the upper side edges of the recess are provided by surfaces of the male edge and of the female edge that have an included angle with the top surface of the panel that is substantially equal to 90°.

Within the context of this disclosure, the term "downwards" and "directed downwards" must be understood as meaning downwards when the floor or wall panel is held with its surface horizontally.

Each of the embodiments of the first aspect of the invention provide floor or wall coverings comprising mechanically coupled panels such that water penetration through the joints between the panels is effectively prevented, thanks to the grouting material in the recess and thanks to the configuration of the coupling parts that create an appropriate locking of the panels for application of grouted floor or wall coverings. The use of grout in the recess further creates increased strength of the coupled panels in the floor or wall covering.

It is a benefit of aspect I that a nice and very effective grout line can be provided to the floor or wall covering, further improving the water tightness of the panel joints and creating strength of the panel joints.

It is a particular benefit of aspect II that a very effective grout line can be created that effectively withstands thermal expansion and contraction of the tiles or panels. Therefore, the grout line is very durable over time, even in conditions with important temperature changes over time.

It is a particular benefit of aspect III that a very effective grout line can be created that effectively withstands thermal expansion and contraction of the tiles or panels. Therefore, the grout line is very durable over time, even in conditions with important temperature changes over time.

It is a benefit of the embodiments of the invention according to aspect IV that an even better sealing of the panel joints is obtained that even more effectively prevents penetration of water through the panel joints. Furthermore, the mechanical strength of the panel coupling is improved as the grout bonds the edges of the panels together.

Embodiments of the invention according to aspect V have the benefit that the coupling has a certain flexibility in the direction parallel with the surface of the panels during installation. Consequently, installation of the floor or wall panels via the mechanical coupling is facilitated. The correct mechanical coupling of the floor or wall panels with a recess between the panels, with a constant width of the recess, is facilitated. Furthermore, contact of the protrusion with the element of the other edge (preferably with the distal end of the other edge) wherein the protrusion is elastically bended creates a coupling with pretension. This pretension reinforces the locking between the coupled panels of the floor or wall covering.

Embodiments of the invention according to aspect VI have the benefit that the floor or wall panels can be manufactured more easily, as milling the edges is facilitated by providing the upper side edges of the recess by surfaces of the male edge and of the female edge that have an included angle with the top surface of the panel that are substantially equal to 90°. It is a further benefit of such embodiments that there is less risk of damaging the upper side edges during production of the panels or during their installation in a covering, especially when the panels, or their substrate or one or more layers of their substrate, comprise rather brittle material.

In preferred embodiments, the second recess comprises a first undercut in the male edge; and the first recess comprises a second undercut in the female edge. Preferably, the first undercut and/or the second undercut have a triangular shape or a shape with a curved edge. It is a benefit of such embodiments that the undercuts provide a locking of the grout, such that the grout is more durably applied onto the floor or wall covering.

In more preferred embodiments, the second recess comprises a third undercut in the male edge and/or the first recess comprises a fourth undercut in the female edge. Preferably the third undercut and/or the fourth undercut have a triangular shape or a shape with a curved edge. It is a benefit of such embodiments that the undercuts provide a locking of the grout, such that the grout is more durably applied onto the floor or wall covering. When a third undercut is provided in the second recess, preferably the third undercut is provided below the first undercut. When a fourth undercut is provided in the first recess, preferably the fourth undercut is provided below the second undercut.

In preferred embodiments, the male coupling parts comprise a tongue. The female coupling parts comprise a groove. Such embodiments will be further referred to as "tongue-groove" embodiments. Preferably, the tongue extends in the direction parallel with the surface of the panel. Preferably, the groove extends in the direction parallel with the surface of the panel. In the case of floor panels, the direction parallel with the surface of the panel is the horizontal direction.

Preferably, the largest thickness of the tongue is less than 70% of the largest opening of the groove. Such embodiments provide an easier coupling of the panels—requiring less efforts during mechanical coupling—while good locking of the floor or wall panels is achieved thanks to the use of the grout.

Preferably, the groove comprises a bottom lip and an upper lip. In the context of this disclosure it is meant that the upper lip is located closer to the top surface of the panel than the bottom lip. Preferably, the locking in the direction parallel with the panel surface (which is the horizontal locking in the case of floor panels) is only provided by contact points or contact surfaces of the bottom lip with the edge of the other panel. In such embodiments, a gap is present between the two edges at an upper level of the floor or wall panels. Grouting material penetrates in this gap, creating more effective water tightness and effective locking of the panels.

Preferably, the groove comprises a bottom lip and an upper lip. Preferably, the contact between the coupled edges is only provided by the bottom lip making contact with the edge of the other panel; and by the tongue making contact with the bottom surface of the upper lip. In such embodiments, a gap is present between the two edges at an upper level of the panels. Grouting material penetrates in this gap, creating more effective water tightness and effective locking of the floor or wall panels.

Preferably, the groove comprises a bottom lip and an upper lip. Preferably, the contact between the coupled edges is only provided by the distal end of the bottom lip making contact with the edge of the other panel; and by the tongue making contact with the bottom surface of the upper lip and with the lower surface of the upper lip. Such embodiments create a large recess for grout to be present, such that a durable grouting can be provided.

In preferred embodiments, the groove comprises a bottom lip and an upper lip. In coupled condition of two panels, the bottom of the tongue contacts the upper surface of the bottom lip at two different zones separated by a gap.

Preferably, the groove comprises a bottom lip and an upper lip. Preferably, the bottom lip extends over a longer distance from the edge of the panel than the upper lip. Such embodiments provide facilitated installation of the floor or wall covering.

In a preferred floor or wall covering according to a 'tongue-groove" embodiment, the groove comprises a bottom lip and an upper lip. The bottom lip comprises a first inwardly inclined contact surface. The bottom of the tongue comprises a second inwardly inclined contact surface. The first inwardly inclined contact surface of the first panel contacts the second inwardly inclined contact surface of the second panel coupled with the first panel, thereby establishing a locking of the first panel and the second panel in the plane of the floor or wall covering.

More preferably in such embodiments, the distal end of the bottom lip of the first panel contacts the edge of the second panel, thereby establishing a locking of the first panel and the second panel in the plane of the floor or wall covering.

Preferably in such embodiments, a gap is provided in horizontal direction between the distal end of the tongue of the second panel and the proximal edge of the first panel.

Preferably, the edge of the second panel exerts a pressure on the distal end of the bottom lip of the first panel, thereby pressing the first inwardly inclined contact surface onto the second inwardly inclined contact surface. The pressure of the edge of the second panel is preferably exerted by a bending force, e.g. by the bending force of a protrusion at the edge of the second panel that contacts the distal end of the bottom lip of the first panel. Such embodiments have the particular benefit that a correct positioning of two coupled panels respective to each other is obtained, thereby establishing a well defined and constant recess for applying grouting material.

Preferably, at least part of the—and preferably the complete—bottom of the recess—and preferably the bottom of the second recess and/or the bottom of the first recess —; is provided in coupled condition by part of the upper surface of the tongue. With upper surface of the tongue is meant the surface of the tongue closest to upper layer of the panel. More preferably, the part of the upper surface of the tongue providing at least part of the—and preferably the complete—bottom of the recess is provided as an inclined plane declining towards the distal end of the tongue. More preferably, the groove comprises a bottom lip and an upper lip. In coupled condition of two floor or wall panels an inclined section of the upper surface of the tongue makes contact with an inclined section of the lower surface of the upper lip.

In preferred embodiments, the male edge comprises an undercut. The bottom section of the undercut is provided by the upper surface of the tongue. Such embodiments provide an effective locking of the grout, such that a durable grouting is obtained. Furthermore, the male edge of such panels can be milled more easily.

In preferred embodiments, the female edge comprises an undercut. In coupled condition of two such panels the bottom section of the undercut is provided by the upper surface of the tongue. Such embodiments provide an effective locking of the grout, such that a durable grouting is obtained.

In preferred embodiments, the female edge comprises an undercut. The undercut is provided above the groove. With above the groove is meant closer to the top layer of the panel than the groove. The undercut is distanced from the groove by a convex section of the female edge. Such embodiments provide an effective locking of the grout, such that a durable grouting is obtained. In addition to the undercut distanced from the groove by a convex section of the female edge, an undercut can be provided in the female edge the bottom section of which is provided in coupled condition of two such panels by the upper surface of the tongue of the coupled panel.

In preferred "tongue-groove" embodiments, the ratio of the distance D parallel with the surface of the panel (which is the horizontal distance in the case of floor panels and floor coverings) over which the tongue extends in the direction parallel with the panel surface from the top surface of the panel edge on which the tongue is provided, over the thickness T of the panels is less than 0.8, preferably less than 0.7, more preferably less than 0.7, even more preferably less than 0.6. Such embodiments provide particularly stable coupling of the edges of the panels.

In a preferred "tongue-groove" embodiment, the groove comprises a bottom lip and an upper lip. In a first section along the edge comprising the male coupling parts, the tongue is configured such that it contacts the bottom surface of the upper lip of the coupled panel. In at least a second section along the edge comprising the male coupling parts, the tongue is configured such that it does not contact the bottom surface of the upper lip of the coupled panel. It means that in such embodiments, the distance over which the tongue extends from the panel edge where it is provided, is not constant along the length of the panel edge where the tongue is provided. The variation of the tongue can be in one or more discrete steps, or gradually. Such coupling parts can be machined by means of milling using rotary tools and using jumpers, as is known in milling technology. As there are sections along the edge of the panel where the tongue does not contact the bottom surface of the upper lip of the coupled panel, grout can flow in gaps provided at the distal end of the tongue and under the tongue, reinforcing the durability of the grouted floor or wall covering. As still sections are present along the edge where the tongue contact the bottom surface of the upper lip, sufficient vertical locking of the panels is obtained. With the bottom surface of the upper lip is meant the surface of the upper lip most distant from the top layer of the panel.

In such embodiments, it is preferred that sections where the tongue contacts the bottom surface of the upper lip of the coupled panel are provided at both ends of the edge comprising the male coupling parts.

In preferred "tongue-groove" embodiments, the coupling parts are configured such that when installing the covering, a panel can be coupled via a turning movement of the panel relative to an already installed panel, wherein the male coupling part of the male edge of the panel is inserted into the female coupling part of the female edge of the already installed panel.

In preferred "tongue-groove" embodiments, the coupling parts are configured such that when installing the covering, a panel can be coupled via a substantially horizontal sliding movement with snap effect of the panel relative to an already installed panel, wherein the male coupling part of the male edge of the panel is inserted into the female coupling part of the female edge of the already installed panel with a snap effect. More preferably, the female edge of the panels comprises a rounded nose above the groove; grouting material contacts and adheres to the upper section of the nose; and preferably grouting material contacts and adheres also at least partially to the bottom section of the nose. More preferably the rounding at the bottom of the nose assists the installation and coupling of the panels via the substantially horizontal sliding movement with snap effect, in that the rounding at the bottom of the nose guides the tongue of the panel to be installed correctly into the groove during the substantially horizontal sliding movement with snap effect.

In a preferred embodiment of the first aspect of the invention, the male coupling part is provided by a downward-directed upper hook-shaped part. The downward-directed upper hook-shaped part comprises—and preferably consists of—a lip with a downward-directed locking element which forms a male part. The female coupling part is provided by an upward-directed lower hook-shaped part. The upward-directed lower hook-shaped part comprises—and preferably consists of—a lip with an upward-directed locking element, which, proximally thereof, defines a female part in the form of a third recess. In the context of this disclosure, with "downward-directed" is meant downward directed when the panel is held horizontally with its top layer at the top of the panel; and with "upward-directed" is meant upward directed when the panel is held horizontally with its top layer at the top of the panel. The male coupling part and the female coupling part are configured such that two of such floor or wall panels can be coupled to each other at their respective edges by means of a movement of the one panel in respect to the other perpendicular to the surface of the panels (this is a downward movement in the case of installing floor panels in a floor covering), such that the panels are locked in the plane of the floor or wall panels and/or perpendicular to the respective edges. Such embodiments will be further referred to as "double hook" embodiments. Preferably, the male coupling part and the female coupling part provide a vertically active locking system by means of vertically active locking parts of the male coupling part and of the female coupling part. With "vertically" is meant here when considered for the installation of floor panels in floor coverings. A mutatis mutandis locking is established with such wall panels being installed in wall coverings.

In a preferred "double hook" embodiment, the floor or wall panels are configured such that the recess extends to a part of the upper surface of the lip of the upward-directed lower hook-shaped part. Grouting material is provided on—and preferably adheres to—part of the upper surface of the lip of the upward-directed lower hook-shaped part. Preferably, the width of the recess at the upper surface of the lip of the upward-directed lower hook-shaped part is at least 1.5 mm, more preferably at least 2 mm, even more preferably at least 2.5 mm.

In a preferred "double hook" embodiment, the proximal end of the downward-directed locking element comprises a first inclined contact surface. The proximal end of the upward-directed locking element comprises a second inclined contact surface. In coupled condition of a first floor or wall panel at the edge comprising the downward-directed locking element, its first inclined contact surface contacts the second inclined contact surface of the panel with which the first panel is coupled at the edge comprising the downward-directed locking element; thereby establishing a locking of the coupled panels in vertical direction. It is meant that decoupling of the panels perpendicularly to the surface of the floor or wall covering is prevented.

In a preferred "double hook" embodiment, the distal end of the upward-directed upper hook-shaped part comprises a locking part, for cooperation with a locking part at the proximal end of the downward-directed upper hook-shaped part of a coupled panel, thereby establishing a locking of the coupled panels in vertical direction (when considered for floor panels). Preferably, this locking does not involve contact of the locking part of the upward-directed upper hook-shaped part with the locking part at the proximal end of the downward-directed upper hook-shaped part of the coupled panel.

In a preferred "double hook" embodiment, in coupled condition of the downward-directed upper hook-shaped part of a first panel with the upward-directed lower hook-shaped part of a second panel, the bottom of the downward-directed locking element of the first panel contacts the lip of the upward-directed lower hook-shaped part of the second panel.

In a preferred "double hook" embodiment, in coupled condition of the downward-directed upper hook-shaped part of a first panel with the upward-directed lower hook-shaped part of a second panel, the lower surface of the lip of the downward-directed upper hook-shaped part of the first panel does not contact the upper surface of the upward-directed locking element of the second panel.

Floor or wall panels of preferred floor or wall coverings comprise first opposing edges and second opposing edges. Preferably the floor or wall panels are square or rectangular; more preferably oblong. The first opposing edges of the floor or wall panels are provided with male and female coupling parts according to "tongue-groove" embodiments. The second opposing edges of the floor or wall panels are provided with male and female coupling parts according to "double hook" embodiments. A recess is provided at the first opposing edges and at the second opposing edges at the surface of the floor or wall covering between floor or wall panels mechanically coupled to each other. Thus, for square or rectangular floor or wall panels, all four edges of panels of such preferred floor or wall coverings are provided with recesses. At the first opposing edges and at the second opposing edges, the recess optionally comprises a first recess cut out or otherwise provided at the female edge, preferably through the top layer and preferably extending into the substrate; and optionally a second recess cut out or otherwise provided at the male edge preferably through the top layer and preferably extending into the substrate. The recess of the first opposing edges and the recess of the second opposing edges comprise a grouting material. Thus, when the floor or wall panel is square or rectangular, a grout line is provided around all four edges of the floor or wall panels in the floor or wall covering. The floor or wall covering comprises at the first opposing edges of the floor or wall panels and/or at the second opposing edges of the floor or wall panels optionally one or a combination of the aspects I-VI.

It is a particular benefit of such embodiments that a grout line is provided around all four edges of square or rectangular (including oblong) floor or wall panels in the floor or wall covering, such that water penetration is prevented at all four edges, while obtaining high strength panel joints. When the decor layer imitates ceramic material, stone or marble, the grout lines around all four edges of square or rectangular (including oblong) floor or wall panels contribute to provide a very realistic imitation of ceramic, stone or marble floor or wall covering.

Floor or wall panels of preferred floor or wall covering are rectangular, square or oblong. The first opposing edges of the floor or wall panels are provided with male and female parts according to any of the "tongue-groove" embodiments. The second opposing edges of the floor or wall panels are also provided with male and female parts according to any of the "tongue-groove" embodiments. A recess is provided at the first opposing edges and a recess is provided at the second opposing edges at the surface of the floor or wall covering between floor or wall panels mechanically coupled to each other. At the first opposing edges and at the second opposing edges, the recess optionally comprises a first recess cut out or otherwise provided at the female edge preferably through the top layer and preferably extending into the substrate; and optionally a second recess cut out or otherwise provided at the male edge preferably through the top layer and preferably extending into the substrate. The recesses at the first opposing edges and at the second opposing edges comprise a grouting material. The floor or wall covering comprises at the first opposing edges of the floor or wall panels and/or at the second opposing edges of the floor or wall panels optionally one or a combination of the aspects I-VI listed in the first aspect of the invention.

In preferred floor or wall coverings, the floor or wall panels are preferably square or rectangular. The first opposing edges of the floor or wall panels are provided with male and female coupling parts as in any "double hook" embodiment. Second opposing edges of the floor or wall panels are provided with male and female coupling parts as in any "double hook" embodiment. A recess is provided at the first opposing edges and at the second opposing edges at the surface of the floor or wall covering between floor or wall panels mechanically coupled to each other. At the first opposing edges and at the second opposing edges, the recess optionally comprises a first recess cut out or otherwise provided at the female edge preferably through the top layer and preferably extending into the substrate; and optionally a second recess cut out or otherwise provided at the male edge preferably through the top layer and preferably extending into the substrate. The recesses at the first opposing edges and at the second opposing edges comprise a grouting material. The floor or wall covering comprises at the first opposing edges of the floor or wall panels and/or at the second opposing edges of the floor or wall panels optionally one or a combination of the aspects I-VI listed in the first aspect of the invention.

The second aspect of the invention is a floor or wall covering comprising floor or wall panels. The panels comprise a substrate and a top layer. The top layer comprises a decor layer, and optionally a wear layer. The panels are provided at least at the edges of two opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally, the coupling parts are provided with integrated mechanical locking means which prevent the drifting apart of two coupled panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part. The male coupling part is provided by a downward-directed upper hook-shaped part. The downward-directed upper hook-shaped part comprises—and preferably consists of—a lip with a downward-directed locking element which forms a male part. The female coupling part is provided by an upward-directed lower hook-shaped part. The upward-directed lower hook-shaped part comprises—and preferably consists of—a lip with an upward-directed locking element, which, proximally thereof, defines a female part in the form of a third recess. The male coupling part and the female coupling part are configured such that two of such panels can be coupled to each other at their respective edges by means of a movement substantially perpendicular to the surface of the panels of the one panel in respect to the other, such that the panels are locked in the plane of the panels and/or perpendicular to the respective edges. The recess comprises a grouting material. Preferably, the movement perpendicular to the surface of the panels to couple the panels is a substantially linear movement perpendicular to the surface of the panels.

Preferably, the decor layer is wear resistant and decorative, preferably to imitate ceramic, stone, marble or other material. Optionally, the substrate comprises a plurality of layers.

Each of the embodiments of the second aspect of the invention provide floor or wall coverings comprising mechanically coupled panels such that water penetration through the joints between the panels is effectively prevented, thanks to the grouting material in the recess and thanks to the configuration of the coupling parts that create an appropriate locking of the panels for application of grouted floor or wall coverings. The use of grout in the recess further creates increased strength of the coupled panels in the floor or wall covering.

A nice and very effective grout line can be provided to the floor or wall covering, which also contributes to the strength of the panel joints.

In preferred embodiments of the second aspect of the invention, in coupled condition of the male coupling part of a panel with the female coupling part of another panel, a locking in vertical direction is provided at the distal end of the downward-directed locking element of the panel. Such locking provides strength to the coupled panels. Furthermore, because of the location of the coupling parts that create this vertical locking, some grouting material can flow at these coupling parts, creating a further adhesive joining of the coupled panels at this position, further improving the strength of the coupled panels; as well as increasing the durability of the applied grout.

Preferably, a nose extends from the proximal end of the edge comprising the female coupling part. The nose interacts with the downward-direct locking element of the coupled panel, thereby providing a locking in vertical direction at the distal end of the downward-directed locking element. Such embodiments provide increased ability of coupling. The upper section of the nose can provide a contact surface for grouting material, increasing the strength of bonding of coupled panels and of the grouting material, increasing the durability of the covering.

More preferably, the vertical locking at the distal end of the downward directed locking element is established at inclined surfaces of the nose and of the downward-directed locking element. Even more preferably, the inclined surfaces are in coupled condition of the panels in contact with each other with pretension.

In a preferred embodiment of the first aspect or of the second aspect of the invention, in coupled condition of two panels, the nose of the first of the coupled panels establishes a first contact surface with the female edge of the second of the coupled panels and a second contact surface with the female edge of the second of the coupled panels. The difference in included angle between the first contact surface and the second contact surface is at least 45°, and preferably at least 75°, more preferably at least 90°. Such configurations allow very efficient coupling of the panels; and very efficient bonding of the grouting material in the covering, increasing the durability of coupling and of the grout in the covering. Optionally, one of the contact surfaces is parallel with the surface of the coupled panels; and/or one of the contact surfaces is perpendicular to the surface of the coupled panels. When one of the contact surfaces is perpendicular to the surface of the coupled panels, additionally a very efficient locking parallel to the surface of the panels and perpendicular to the coupled edges is established; and the width of the recess for providing grout is well determined.

In embodiments wherein one of the contact surfaces is parallel with the surface of the coupled panels, a very effective locking in the direction perpendicular to the surface of the coupled panels is obtained.

Preferably, the grouting material contacts the upper part of the nose at least partially. Such embodiments provide coverings with increased durability, as an improved bonding of the panels in the covering and of the grouting material in the covering is obtained.

In a preferred embodiment of the second aspect of the invention, the proximal end of the edge comprising the female coupling part comprises an undercut. The undercut interacts with the downward-direct locking element of the coupled panel, thereby providing a locking in vertical direction at the distal end of the downward-directed locking element.

In preferred embodiments of the second aspects of the invention, no vertical locking is provided between coupled panels at the proximal end of the upward-directed locking element nor at the proximal end of the downward-directed locking element. More preferably, the proximal end of the upward-directed locking element contacts the proximal end of the downward-directed locking element with pretension. Such embodiments provide flexibility in the panel, such that coupling of the panels in the floor or wall covering is facilitated.

In a preferred embodiment of the second aspect of the invention, the proximal end of the downward-directed locking element comprises a first inclined contact surface. The proximal end of the upward-directed locking element comprises a second inclined contact surface. In coupled condition of a first panel at the edge comprising the downward-directed locking element, its first inclined contact surface contacts the second inclined contact surface of the panel with which the first panel is coupled at the edge comprising the downward-directed locking element; thereby establishing a locking of the coupled panels in vertical direction. More preferably, this vertical locking is established with pretension. This pretension has the benefit that it helps to establish proper locking in the direction parallel with the surface of the coupled panels, and to define the width of the recess in which grouting material is provided.

In a preferred embodiment of the second aspect of the invention, in coupled condition of the male coupling part of a panel with the female coupling part of another panel, no locking in vertical direction is provided at the distal end of the upward-directed locking element.

In a preferred embodiment of the second aspect of the invention, in coupled condition of the male edge of a panel with the female edge of another panel, a locking in vertical direction is provided at the distal end of the upward-directed locking element. This vertical locking can be provided with or without contact.

More preferably, the distal end of the upward-directed locking element comprises an undercut. The bottom surface of the undercut is provided for establishing a locking in vertical direction.

In a preferred embodiment of the second aspect of the invention, the upward-directed locking element contacts the proximal edge of the panel with which it is coupled at the distal end of the upward-directed locking element; and/or the distal end of the upward-directed locking element comprises an undercut and the upward-directed locking element contacts the proximal edge of the panel with which it is coupled at the undercut of the upward-directed locking element.

In a preferred embodiment of the second aspect of the invention, the panel comprises at the proximal edge of its male edge a corresponding hook. The corresponding hook is provided for interacting with the upward-directed locking element of a coupled panel for establishing a locking in vertical direction.

In a preferred embodiment of the second aspect of the invention, a locking in horizontal direction between neighboring panels is provided by contact between coupled panels at the distal end of the downward-directed locking element. This locking in horizontal direction is also beneficial to define the width of the recess in which grout is provided.

In a preferred embodiment of the second aspect of the invention, the coupling parts are configured such that when installing the covering, panels can be coupled via a turning movement of a panel relative to an already installed panel, wherein the male coupling part of the male edge is inserted into the female coupling part of the female edge of the already installed panel.

In a preferred embodiment of the second aspect of the invention, the coupling parts are configured such that when installing the covering, panels can be coupled via a substantially horizontal sliding movement with snap effect of a panel relative to an already installed panel, wherein the male coupling part of the male edge is inserted into the female coupling part of the female edge of the already installed panel with a snap effect.

In a preferred embodiment of the second aspect of the invention, the coupling parts are configured such that at least before applying the grouting material to the covering, a panel can be removed from the covering via a turning movement of one panel with respect of another panel, wherein the male coupling part of the male edge is removed out of the female coupling part of the female edge of the another panel. Such embodiments provide the benefit that panels can be removed from the covering during the installation process before the grouting material is applied. This facilitates installation, as errors during installation can be more easily rectified.

In a preferred embodiment of the second aspect of the invention, the grouting material contacts at least part of the upper surface of the downward-directed locking element. It is a benefit of such embodiments that a more durable covering is obtained, as the grouting material is better bonded into the covering, and the panels are more firmly anchored to each other.

In a preferred embodiment of the second aspect of the invention, the upper surface of the downward-directed locking element comprises a step. Preferably, the grouting material contacts the step. It is a benefit of such embodiments that the mechanical strength of the downward-directed locking element is improved, while a recess with larger volume is provided for grouting material. The larger the volume of grouting material, the stronger and the more durable the grout in the covering.

In a preferred embodiment of the second aspect of the invention, the male edge and the female edge comprise an undercut. Each of these undercuts comprise grouting material. Such embodiments provide firmer bonding of the grouting material into the covering, resulting in higher durability of the grout lines provided in the covering.

In a preferred embodiment of the second aspect of the invention, a cut is provided in the panels extending from the bottom of the panel, wherein the cut is provided proximal to the male edge of the panel. More preferably, the cut extends from the bottom of the panel into the panel for more than 30% of the thickness of the panel. The cut provides a flexibility at the male edge of the panel. This allows some flexible bending of the male edge during coupling of the panels when being coupled in the covering. Thanks to the presence of this flexibility, larger tolerance can be allowed when milling the coupling parts at the edges of the panels. Therefore, manufacturing of the panels is facilitated.

In a preferred such embodiment, the cut makes an angle between 75° and 105° degrees with the bottom of the panels. More preferably the cut extends towards the distal end comprising the male edge when observed from the inside of the panel towards the bottom of the panel. It is a benefit of such embodiments that milling is facilitated, as the milling tools can be positioned closer to the chains of the continuous milling machine which is used. Closer positioning of the milling tools to the chains of the continuous milling machines enables to achieve narrower milling tolerances.

Alternatively, the cut can extend perpendicularly to the bottom of the panel.

In a preferred embodiment of the second aspect of the invention, the recess optionally comprises a first recess cut out or otherwise provided at the female edge, preferably through the top layer and preferably extending into the substrate. The recess comprises optionally a second recess cut out or otherwise provided at the male edge preferably through the top layer and preferably extending into the substrate. Such embodiments provide increased durability of the grouting material in the covering thanks to its better bonding in the floor covering.

In a preferred embodiment of the second aspect of the invention, the floor or wall covering comprises optionally one or a combination of the following options:

- the recess comprises or consists of a surface of the male edge and/or of the female edge having an included angle with the top surface of the panel to which the edge belongs that is less than 90°, preferably less than 85°, and preferably more than 70°; preferably said surface of the male edge and/or said surface of the female edge intersects with the top surface of the panel on which it is provided;
- at least one of the female edge or the male edge comprises a protrusion, preferably directed substantially downwards when the panel is put horizontally, wherein the protrusion is preferably provided by removal of material at the bottom of the panel or otherwise provided, e.g. by extrusion; the protrusion makes contact with an element of the other edge—preferably the protrusion makes contact with the distal end of the other edge—thereby locking the panels horizontally in a flexible way; preferably the lower end of the protrusion is provided at the same level as the bottom of the panel;
- the upper side edges of the recess are provided by surfaces of the male edge and of the female edge that have an included angle with the top surface of the panel that are substantially equal to 90°.

In a preferred embodiment of the second aspect of the invention, the panels are rectangular, square or oblong. The panels comprise a second set of opposite sides. The edges of the second set of opposite sides comprise coupling parts configured as in the edges of the two opposite sides as in any embodiment of the second aspect of the invention. Such embodiments have the benefit that the panels can be installed in the floor covering by means of a vertical downward movement at the first set of opposite sides and at the second set of opposite sided. This allows installing the panels in a vertical downward movement in the same way as can be done with ceramic tiles. Thus, the installation can be done in a similar way as with ceramic tiles.

In a preferred embodiment of the second aspect of the invention, the panels are rectangular, square or oblong. The panels comprise a second set of opposite sides. The edges of the second set of opposite sides comprise coupling parts configured such that two panels can be coupled in the covering at their second set of opposite sides by a substantially vertically downward movement of a panel relative to a panel already installed in the covering. Such embodiments have the benefit that the panels can be installed in the floor covering by means of a vertical downward movement at the first set of opposite sides and at the second set of opposite sided. This allows installing the panels in a vertical downward movement in the same way as can be done with ceramic tiles. Thus, the installation can be done in a similar way as with ceramic tiles.

In a preferred embodiment of the second aspect of the invention, the panels are rectangular, square or oblong. The coupling parts of the edges of the first set of opposite sides are configured such that two panels can be coupled in the covering at their second set of opposite sides by a substantially vertical downward movement of a panel relative to a panel already installed in the covering. The panels comprise a second set of opposite sides, wherein the edges of the second set of opposite sides comprise coupling parts configured such that two panels can be coupled in the covering at their second set of opposite sides by a substantially vertically downward movement of a panel relative to a panel already installed in the covering. Such embodiments have the benefit that the panels can be installed in the floor covering by means of a vertical downward movement at the first set of opposite sides and at the second set of opposite sided. This allows installing the panels in a vertical downward movement in the same way as can be done with ceramic tiles. Thus, the installation can be done in a similar way as with ceramic tiles.

In a preferred embodiment of the second aspect of the invention, the panels are rectangular, square or oblong. The panels comprise a second set of opposite sides. The edges of the second set of opposite sides comprise coupling parts configured such that panels can be coupled at their second set of opposite sides by a turning movement of their male edge into the female edge of the neighboring panel during installation of the covering. Such embodiments allow that the panels can be installed in the covering by means of the fold-down installation method for installing panels. In this fold-down method, a panel is turned at the male edge of its second set of opposite sides into the female edge of the second set of opposite sides of an already installed panel; and in the same movement the male edge of the first set of opposite sides of the panel is via a substantially vertical downward movement coupled into the female edge of the first set of opposite sides of another already installed panel.

A third aspect of the invention is a floor or wall covering, optionally as in any embodiment of the first and/or second aspect of the invention. The floor or wall covering comprises floor or wall panels. The panels comprise a substrate and a top layer. The top layer comprises a decor layer, and optionally a wear layer. The panels are provided at least at the edges of two opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally, the coupling parts are provided with integrated mechanical locking means which prevent the drifting apart of two coupled panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part. The recess comprises a grouting material. The covering is characterized in that the decor layer ends at the edges of the two opposite provided with coupling parts in the view perpendicular to the surface of the panel along non-linear lines.

It is a benefit of this aspect of the invention that a more realistic imitation of a ceramic tile is obtained, as a linear end of the decor at the edges provides a more artificial, "synthetic" look.

In a preferred embodiment of the third aspect of the inventio, the non-linear lines are non-linear structured lines. More preferably, the non-linear lines are crenated or undulated lines, whether regularly or irregularly undulated lines; and/or the non-linear lines comprises one or a plurality of notches.

In a preferred embodiment of the third aspect of the invention, the panel is rectangular, square or oblong. The decor layer ends at each of the four edges of the panel in the view perpendicular to the surface of the panel along non-linear lines. Grout is provided around the full circumference of the surface of the panels.

In a preferred embodiment of the third aspect of the invention, all four non-linear lines are non-linear structured line. More preferably, the non-linear lines are crenated lines or undulated lines, whether regularly or irregularly undulated lines; and/or the non-linear lines comprises one or a plurality of notches.

In a preferred embodiment of the third aspect of the invention, the non-linear lines are created via impression with a roller or with a pressing device. More preferably, the roller or the pressing device is a heated roller, or the pressing device is a heated pressing device.

In a preferred embodiment of the third aspect of the invention, the panel edges are heated in order to create the non-linear lines via impression with the roller or with the pressing device.

The fourth aspect of the invention is a floor or wall covering, optionally as in any embodiment of the first, second or third aspect of the invention. The floor or wall covering comprises floor or wall panels. The panels are rectangular, square or oblong, wherein the shortest of the sides is larger than 250 millimeter, preferably larger than 300 millimeter, more preferably larger than 600 millimeter. If the panel is square, each of the sides has the same length, equal to the length of the shortest of the sides. The panels comprise a substrate and a top layer. The layer comprises a decor layer; and optionally a wear layer. The panels are provided at least at the edges of a first set of opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally, the coupling parts are provided with integrated mechanical locking means which prevent the drifting apart of two coupled panels into the direction perpendicular to the surface of the floor or wall covering and/or into the direction perpendicular to the respective edges in the plane of the floor or wall covering. A grouting material is provided around the full circumference of the decor layer of the panels.

It is a benefit of this aspect of the invention that an imitation is provided of a floor or wall covering out of ceramic or stone tiles in material that has mechanically locking parts. The panels used in the invention can be made from a large board that is split in panels, e.g. by means of sawing operations. Normally, squareness is problematic with panels of the size as specified in this aspect of the invention. The use of the grouting material around the circumference of the decor of the panels, allows to resolve imperfect squareness of the panels.

In a preferred embodiment of the fourth aspect of the invention, the edges of the second set of opposite sides are provided with coupling parts, cooperating which each other, substantially in the form of male coupling parts and female coupling parts, for coupling the panels to each other in the floor or wall covering. The male coupling part of the second set of opposite sides is provided at the male edge of the panels. The female coupling part of the second set of opposite sides is provided at the female edge of the panels. The coupling parts at the second set of opposite sides are provided with integrated mechanical locking means which prevent the drifting apart of two coupled panels into the direction perpendicular to the surface of the floor or wall covering and/or into the direction perpendicular to the respective edges and in the plane of the floor or wall covering.

In a preferred embodiment of the fourth aspect of the invention, at one or at both edges of the first set of opposite sides, a recess is provided at the surface of the floor or wall covering between two panels mechanically coupled to each other by the male coupling part and the female coupling part. The recess comprises grouting material.

In a preferred embodiment of the fourth aspect of the invention, at one or at both edges of the second set of opposite sides, a recess is provided at the surface of the floor or wall covering between two panels mechanically coupled to each other by the male coupling part and the female coupling part. The recess at one or at both edges of the second set of opposite sides comprises grouting material.

In a preferred embodiment of the fourth aspect of the invention, the coupling parts at the first set of opposite sides are configured such that two panels in the covering can be coupled at their first set of opposite sides by a substantially vertically downward movement of the edge comprising the male coupling part into the edge comprising the female coupling part.

In a preferred embodiment of the fourth aspect of the invention, the coupling parts at the second set of opposite sides are configured such that two panels in the covering can be coupled at their second set of opposite sides by a substantially vertically downward movement of the edge comprising the male coupling part into the edge comprising the female coupling part.

In a preferred embodiment of the fourth aspect of the invention, the coupling parts at the first set of opposite sides are configured such that two panels in the covering can be coupled at their first set of opposite sides by a turning movement of the edge comprising the male coupling part into the edge comprising the female coupling part.

In a preferred embodiment of the fourth aspect of the invention, the coupling parts at the second set of opposite sides are configured such that two panels in the covering can be coupled at their second set of opposite sides by a turning movement of the edge comprising the male coupling part into the edge comprising the female coupling part.

In a preferred embodiment of the fourth aspect of the invention, the panels are configured such that after installation in the covering and before applying the grouting material, two panels coupled at their first set of opposite sides can be uncoupled at their first set of opposite sides by a turning movement of the edge comprising the male couple part, relative to the edge comprising the female coupling part.

In a preferred embodiment of the fourth aspect of the invention, the panels are configured such that after installation in the covering and before applying the grouting material, two panels coupled at their second set of opposite sides can be uncoupled at their second set of opposite sides by a turning movement of the edge comprising the male couple part relative to the edge comprising the female coupling part.

In preferred embodiments of any one of the first, second, third or fourth aspect of the invention, the recess is symmetrical relative to a plane perpendicular to the panel surface.

Preferred grouting material for use in any embodiment of the first, second, third or fourth aspect of the invention is an elastic grouting material, e.g. epoxy, acrylic, urethane or latex based grouting material. It is a benefit of preferred grouting material that thermal expansion and contraction of the floor or wall panels can be accepted by the grout lines between floor or wall panels in the inventive floor or wall covering.

A preferred floor covering according to any embodiment of the first, second, third of fourth aspect of the invention is a floating floor covering provided on an underfloor, e.g. on strips or sheets of polyethylene—more preferably cross-linked polyethylene, or on strips or sheets of polyurethane.

Preferred floor or wall covering according to any embodiment of the first, second, third of fourth aspect of the invention is a floor or wall covering wherein the floor or wall panels are attached to the floor or to the wall by means of an adhesive. Such embodiments provide even increased durability of the floor or wall covering.

Preferred wall coverings according to any embodiment of the first, second, third of fourth aspect of the invention are wall coverings wherein the wall panels are attached to the wall or to a carrying structure, e.g. by mean of an adhesive.

Preferably according to any embodiment of the first, second, third of fourth aspect of the invention, a resilient polymer layer is provided attached at the bottom of the floor or wall panel and providing the bottom of the floor or wall panel. Preferably, the resilient polymer layer is provided for equalizing irregularities in the surface onto which the floor or wall covering is provided and/or for sound dampening especially in the case of floor coverings.

Preferably according to any embodiment of the first, second, third of fourth aspect of the invention, the male coupling parts and the female coupling parts are created out of material of the floor or wall panel, more preferably out of the substrate.

Preferably according to any embodiment of the first, second, third of fourth aspect of the invention, the integrated mechanical locking means which prevent the drifting apart of two coupled floor or wall panels into the direction perpendicular to the surface of the floor or wall covering create a mechanical locking with play—preferably the play is less than 0.3 mm —; or without play between the coupled floor or wall panels in the direction perpendicular to the surface of the floor or wall covering.

Preferably according to any embodiment of the first, second, third of fourth aspect of the invention, the integrated mechanical locking means which prevent the drifting apart of two coupled floor or wall panels perpendicular to the respective edges in the plane of the floor or wall covering create a mechanical locking with play—preferably the play is less than 0.3 mm —; or without play between the coupled floor or wall panels perpendicular to the respective edges in the plane of the floor or wall covering.

In a preferred floor or wall covering according to any embodiment of the first, second, third of fourth aspect of the invention, the integrated mechanical locking means which prevent the drifting apart of two coupled floor or wall panels into the direction perpendicular to the surface of the floor or wall covering create a snap-together connection.

In a preferred floor or wall covering according to any embodiment of the first, second, third of fourth aspect of the invention, the integrated mechanical locking means which prevent the drifting apart of two coupled floor or wall panels perpendicular to the respective edges in the plane of the floor or wall covering create a snap-together connection.

Preferably according to any embodiment of the first, second, third of fourth aspect of the invention, at least one of the female edge or the male edge—and more preferably both—comprises a protrusion, preferably directed substantially downwards (with downwards is meant considered when the surface of the panel is held horizontal). This protrusion is preferably provided by removal of material at the bottom of the panel or otherwise provided, e.g. by extrusion. The protrusion makes contact with an element of the other edge—preferably with the distal end of the other edge—thereby locking the panels in the plane of the panels in a flexible way; wherein the protrusion is in coupled condition elastically bended.

In preferred "tongue-groove" embodiments, the groove comprises a bottom lip and an upper lip. A protrusion—preferably directed substantially downwards (meant is downwards when the panel is held with its surface horizontally)—is provided at the male edge. The protrusion contacts the distal end of the bottom lip, thereby locking the panels in the plane of the panels in a flexible way. The protrusion is in coupled condition elastically bended. This protrusion is preferably provided by removal of material at the bottom of the panel or otherwise provided, e.g. by extrusion.

Preferably according to any embodiment of the first, second, third of fourth aspect of the invention, at least one of the female edge or the male edge—and more preferably both—comprises a protrusion, preferably directed substantially downwards (meant is downwards when the panel is held with its surface horizontally). This protrusion is preferably provided by removal of material at the bottom of the panel or otherwise provided, e.g. by extrusion. The lower end of the protrusion is provided at the same level as the bottom of the floor or wall panels.

In a preferred floor or wall covering according to any embodiment of the first, second, third of fourth aspect of the invention, all floor or wall panels of the floor or wall covering are identically configured with respect to their mechanical coupling means. More preferably, all floor or wall panels of the floor or wall covering are identical.

In a preferred floor or wall covering as in any embodiment of the first, second, third or fourth aspect of the invention, one, more than one or all edges of the panels are provided with bevels. The bevels optionally can be linearly inclined or curved. More preferably, the decor layer extends onto the bevel. In a preferred embodiment, at least in a cross section through the bevel, cross section which is perpendicular to the surface of the covering and parallel with the edge of the panel wherein the bevel is provided, the bevel has an irregular surface. Such embodiments provide a more realistic imitation of ceramic tiles.

The fifth aspect of the invention is a floor or wall covering comprising floor or wall panels. Optionally, the floor or wall covering is a floor or wall covering as in any embodiment of any of first, second, third or fourth aspect of the invention. The panels comprise a substrate and a top layer. The top layer comprises a decor layer; and optionally a wear layer. The panels are provided at least at the edges of two opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally, the coupling parts are provided with integrated mechanical locking means which prevent the drifting apart of two coupled panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part. The recess comprises at both its side surfaces one or more of an undercut or a protrusion; and the recess comprises a grouting material. The presence of the one or more of an undercut or a protrusion at both side surfaces of the recess improves the anchoring of the grouting material.

The sixth aspect of the invention is a floor or wall covering comprising floor or wall panels, optionally as in any embodiment of anyone of the already described aspects of the invention. The panels comprise a substrate and a top layer. The top layer comprises a decor layer; and optionally a wear layer. The panels are provided at least at the edges of two opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally, the coupling parts are provided with integrated mechanical locking means which prevent the drifting apart of two coupled panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part. The recess optionally comprises a first recess cut out or otherwise provided at the female edge preferably through the top layer and preferably extending into the substrate; and optionally a second recess cut out or otherwise provided at the male edge preferably through the top layer and preferably extending into the substrate. The recess comprises a grouting material. The panels comprise on their surface a groove, preferably wherein the groove is provided between and parallel with the two opposite sides comprising coupling parts, optionally the panels comprise on their surface a plurality of grooves provided between en parallel with the two opposite sides comprising coupling part. The groove(s) comprise(s) a grouting material. It is a benefit of this aspect of the invention that more complex laying patterns become possible, and as less panels are required to install floor, wall or ceiling coverings with such laying patterns, installation can be done faster and in a more easy way.

Preferably, the same type of grouting material is provided in the groove(s) as in the recess. It makes it possible to grout grooves and recesses in one grouting operation, which saves time during the installation operation of the panels.

Preferably, the groove comprises at its both side surfaces one or more of an undercut or a protrusion. Such embodiments provide the benefit that improved grout anchoring is obtained.

Preferably, at least one distance from the surface of the panel is provided where the width of the groove at that distance from the surface of the panel is larger than the width of the groove at the surface of the panel. Such embodiments provide the benefit that improved grout anchoring is obtained.

Preferably, the upper surface of the groove has substantially the same width as the upper surface of the recess. It is a benefit that after installation of the panels and after grouting the covering appears to consist of a larger number of smaller panels than the real size of the panels. This allows to speed up installation, and to provide more complex laying patterns.

Preferably, the edges of the two opposite sides provided with coupling parts are provided with bevels. The bevels optionally can be linearly inclined or curved. Preferably, the decor layer extends onto the bevel. Preferably, in at least a cross section through the bevel—cross section which is perpendicular to the surface of the covering and parallel with the edge of the panel wherein the bevel is provided—the bevel has an irregular surface. The panels are provided at both sides of the groove with bevels, wherein the bevels are substantially similar to the bevels provided at the edges of the two opposite sides provided with coupling parts. It is a benefit that after installation of the panels and after grouting, the covering appears to consist of a larger number of smaller panels than the real size of the panels. This allows to speed up installation, and to provide more complex laying patterns.

Preferably, the groove is provided in the middle between the recesses at both edges of the pair of opposite edges provided with coupling parts. It is a benefit that after installation of the panels and after grouting, the covering appears to consist of a larger number of smaller, equally sized panels than the real size of the panels. This allows to speed up installation, and to provide more complex laying patterns.

Preferably, the groove on the panels delimits a first decoration pattern from a second decoration pattern. More preferably, the panels are rectangular and oblong, even more preferably the length of the panels is double the width of the panels or the length of the panels is an integer multiple of the width of the panels. It is a benefit that after installation of the panels and after grouting, the covering appears to consist of a larger number of smaller, equally sized panels than the real size of the panels. This allows to speed up installation, and to provide more complex laying patterns, as different decoration patterns are provided on the panels.

Preferably, the groove of a first panel is aligned with the recess of one of the edges of the pair of opposing edges comprising coupling parts of a neighboring panel with which the first panel is coupled. More preferably, the grouting material extends continuously from said groove into the recess with which the groove is aligned. It is a benefit of this embodiment that after installation of the panels and after grouting, the covering appears to consist of a larger number of smaller, equally sized panels than the real size of the panels. This allows to speed up installation, and to provide more complex laying patterns. It also allows to realistically simulate floor coverings comprising ceramic tiles.

Preferably, the groove of the panels is provided such to provide a checkerboard pattern in the floor or wall covering.

In a preferred embodiment of the sixth aspect of the invention, the panels comprise a second set of opposite sides, wherein the edges of the second set of opposite sides comprise coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. Optionally the coupling parts at the second set of opposite sides are provided with integrated mechanical locking means which prevent the drifting apart of two coupled panels into the direction perpendicular to the surface of the floor or wall covering and/or into the direction perpendicular to the respective edges in the plane of the floor or wall covering. A recess is provided at the surface of the floor or wall covering between two panels mechanically coupled to each other by the male coupling part and the female coupling part at the second set of opposite sides. The recess at the second set of opposite sides optionally comprises a first recess cut out or otherwise provided at the female edge at the second set of opposite sides, preferably through the top layer and preferably extending into the substrate; and optionally a second recess cut out or otherwise provided at the male edge of the second set of opposite sides preferably through the top layer and preferably extending into the substrate. The recess at the second set of opposite sides comprises a grouting material. The panels comprise on their surface a second groove, wherein the second groove is provided between and parallel with the second set of opposite sides comprising coupling parts, wherein the second groove comprises a grouting material. Thus, the panels of such embodiments comprise grooves in two different directions. It is a benefit of this aspect of the invention that more complex laying patterns become possible, and as less panels are required to install floor, wall or ceiling coverings with such laying patterns, installation can be done faster and in a more easy way.

Preferably, the second groove comprises the same type of grouting material as the recess. More preferably, grouting material continues without interruption from second grooves to adjoining recesses. Such embodiments facilitate and speed up the installation of a covering and allow to provide coverings with more complex laying patterns.

Preferably, the width of the recess at the second set of opposite sides is substantially the same as the width of the second groove. It is a benefit that after installation of the panels and after grouting the covering appears to consist of a larger number of smaller panels than the real size of the panels. This allows to speed up installation, and to provide more complex laying patterns.

Preferably, at the surface of the panel the width of the groove and the width of the second groove are substantially the same. It is a benefit that after installation of the panels and after grouting the covering appears to consist of a larger number of smaller panels than the real size of the panels. This allows to speed up installation, and to provide more complex laying patterns.

Preferably, the second groove comprise at its both side surfaces one or more of an undercut or a protrusion. Such embodiments provide increased grout anchoring.

Preferably, at least one distance from the surface of the panel is provided where the width of the second groove at that distance from the surface of the panel is larger than the width of the second groove at the surface of the panel. Such embodiments provide enhanced grout anchoring in the second groove.

In a preferred embodiment, the edges of the second set of two opposite sides provided with coupling parts are provided with bevels. The bevels optionally can be linearly inclined or curved; preferably wherein the decor layer extends onto the bevel. Preferably, wherein in at least a cross section through the bevel—cross section which is perpendicular to the surface of the covering and parallel with the edge of the panel wherein the bevel is provided—the bevel has an irregular surface. The panels are provided at both sides of the second groove with bevels, wherein the bevels at both sides of the second groove are substantially similar to the bevels provided at the edges of the second set of two opposite sides provided with coupling parts. It is a benefit that after installation of the panels and after grouting, the covering appears to consist of a larger number of smaller panels than the real size of the panels. This allows to speed up installation, and to provide more complex laying patterns.

The seventh aspect of the invention is a floor or wall panel for use in any embodiment of floor or wall covering of the first, second, third, fourth, fifth or sixth aspect of the invention.

A preferred floor or wall panel according to the seventh aspect of the invention comprises a removable protective layer for covering the decorative upper surface during installation of the floor or wall panel. Such embodiments of the invention prevent that grout could create a haze on the decorative upper surface. The removable protective layer preferably is a plastic sheet, more preferably a waterproof plastic sheet adhered to the floor or wall panel by means of an adhesive.

Preferred floor or wall panels according to the seventh aspect of the invention are Wood Plastic Composite (WPC), Luxury Vinyl Tile (LVT) or Stone Plastic Composite (SPC). Such panels exist that are water resistant floor or wall panels.

The decor layer of preferred floor or wall panels is less than 1 mm thick.

In preferred floor or wall panels according to the seventh aspect of the invention, the decor layer is not a ceramic layer and is not a natural stone layer.

Preferably, the decor layer comprises a polymer, preferably a thermoset polymer or a thermoplastic polymer, more preferably polyvinylchloride (PVC).

Preferred decor layers comprise a printed decor layer. More preferably the decor layer comprises a printed paper layer or a printed plastic layer or the printed decor layer is provided by printing on the substrate itself.

Preferably, the substrate of the floor or wall panel comprises a core. The core comprises a thermoplastic polymer—preferably polyvinylchloride—comprising filling material, e.g. one or more of stone particles, chalk, wood fibers or natural fibers.

Preferred floor or wall panels are square or rectangular, more preferably oblong.

Preferably, the substrate of the floor or wall panel is water resistant, for instance such that when the floor or wall panel is immersed in water during a period of 24 hours, the increase in thickness is less than 3%.

The substrate can comprise different materials, according to a number of embodiments of the invention.

According to a first possibility, the substrate of the floor or wall panel can be mineral based, e.g. based on cement, on lime cement, on magnesium cement or on gypsum. In case of lime cement or portland cement, the substrate preferably is a panel out of fiber cement, e.g. of the type that is obtained in the so-called Hatschek process, e.g. as described in GB6455 of 1900. In case of magnesium cement, the substrate is substantially provide as a so-called magnesium oxide panel, e.g. as described in KR10-1152155B1, e.g. by curing of a slurry of magnesium oxide (50-70 percent by weight) and magnesium chloride (15-35 percent by weight), optionally with filling material (0-15 percent by weight) such as wood particles. Preferably, such magnesium oxide panel comprises at one or at both surfaces a glass fiber layer, preferably a woven glass fiber layer. In case of gypsum, the substrate substantially is a fiber gypsum panel, wherein the fibers can be cellulose fibers and/or glass fibers. Such fiber gypsum panel is preferably obtained by the hydraulic curing of gypsum slurry comprising fibers. Such fiber gypsum panel can be provided on one or on both of its surfaces with a reinforcement layer, such as paperboard and/or a glass fiber layer, preferably a non-woven glass fiber layer.

According to the second possibility, the substrate of the floor or wall panels is substantially a synthetic composite material. The synthetic composite material comprises a polymer matrix, e.g. a thermoplastic matrix or a polyurethane matrix; and filling material. Preferably, the density of the filling material is higher than the density of the material of the polymer matrix. Filling materials having a higher density than the material of the polymer matrix positively affect the dimensional stability of the floor or wall panel. Examples of filling materials that can be used are lime, limestone and talcum. Other mineral filling materials or organic filling materials, such as wood particles, straw or bamboo particles are not excluded Preferably, the amount of filling material in the synthetic composite material is at least 40 percent by weight, preferably at least 50 percent by weight, more preferably 65 percent by weight, even more preferably more than 80 percent by weight. Particularly preferred is the use of mineral filling materials—such as lime, limestone or talc—between 65 and 87 percent by weight of the synthetic composite material.

In a particularly preferred embodiment of the second possibility, the polymer matrix comprises or consists of polyvinyl chloride. Preferably the polyvinyl chloride is free from plasticizers or comprises plasticizers in an amount less than 20 phr; more preferably in an amount between 5 and 15 phr; and even more preferably in an amount less than 5 phr. Such polymer matrix can, in the way as already mentioned, be filled with mineral filling material. Preferably, the amount of filling material in the synthetic composite material is at least 40 percent by weight, preferably at least 50 percent by weight, more preferably 65 percent by weight, even more preferably more than 80 percent by weight. Particularly preferred is the use of mineral filling materials—such as lime, limestone or talc—between 65 and 87 percent by weight of the synthetic composite material. It is a benefit that the floor or wall coverings according to the first, second, third, fourth, fifth or sixth aspect of the invention that comprise panels according to this particularly preferred embodiment of the second possibility, are even more durable.

According to a second example of the second possibility, the polymer matrix comprises or consists of polypropylene, or polyethylene, or polyethylene terephthalate. Optionally, the polymer matrix material comprises an elastomer. As an example, the substrate material described in WO2017/122149 can be used. Such polymer matrix can, in the way as already mentioned, be filled with mineral filling material. Preferably, the amount of filling material in the synthetic composite material is at least 40 percent by weight, preferably at least 50 percent by weight, more preferably 65 percent by weight, even more preferably more than 80 percent by weight. Particularly preferred is the use of mineral filling materials—such as lime, limestone or talc—between 65 and 87 percent by weight of the synthetic composite material.

The material of the substrate can have a uniform composition over its thickness, without differences worth mentioning in composition or density over the thickness of the substrate. Preferably in such embodiments, the material of the substrate is free of inclusions of air, as is the case is unfoamed thermoplastic matrix material.

According to an alternative embodiment, the substrate can comprise layers having different composition. As an example, an internal layer can be foamed, e.g. comprising a closed-cell polyvinyl chloride foam, while one or both bordering layers are unfoamed, or less foamed. As well as in substrates having a uniform composition over its thickness as in substrates comprising two or more than two layers, one or more reinforcement layers can be integrated in or on the substrate. Such reinforcement layers can e.g. comprise or be glass fiber layers, e.g. woven glass fiber layers or non-woven glass fiber layers.

The eighth aspect of the invention is a floor or wall covering as in any embodiment of the first, second, third, fourth, fifth or sixth aspect of the invention comprising and/or made with floor or wall panels as in any embodiment of the seventh aspect of the invention.

The panels in any embodiments of floor or wall panels according to any of the aspects of the invention; or used in floor or wall coverings according to the inventions can be provided with one or more bevels or beveled edges.

The ninth aspect of the invention is a method for installing a floor or wall covering according to any embodiment of the first, second, third, fourth, fifth, sixth or eighth aspect of the invention. The method comprises the steps of providing floor or wall panels as in the seventh aspect of the invention. The floor or wall panels are installed by mechanically coupling the floor or wall panels by coupling the male coupling parts with the female coupling parts. The method comprises the further step of applying grout into the recesses provided at the surface of the floor or wall covering between the floor or wall panels mechanically coupled to each other by the male coupling part and the female coupling part.

In a preferred method, the floor or wall panels comprise a removable protective layer that covers the decorative upper surface; or the surface of the floor or wall panels are provided at their edges with a masking tape, before or after mechanically coupling the floor or wall panels. The method comprises the further step of removing the removable protective layer or the masking tape after application of the grout. Such embodiments of the method allow to provide water-tight coupling between floor or wall panels in the floor or wall covering while preventing that grout could leave traces on the surface of the floor or wall panels.

In a preferred method, after mechanical coupling the floor or wall panels by coupling the male coupling parts with the female coupling parts, the surface of the floor or wall panels is moistened prior to applying the grout into the recesses. More preferably water is used to moisten the surface of the floor or wall panels. Optionally, the water can comprise a surfactant. It is a benefit of such embodiments that—after the grouting operation—grout can be more easily removed from the surface of the floor or wall panels.

In a preferred method, the installation of the floor or wall panels also involves attaching the floor or wall panels to the floor or to the wall by means of an adhesive.

In a preferred method, the method is a method for installing a wall covering. The installation of the wall panels also involves attaching the wall panels to the wall or to a supporting structure, preferably by means of an adhesive.

The tenth aspect of the invention is a floor covering, optionally a floor covering according to any embodiment of any of the other aspects of the invention. The floor covering comprises floor panels, an elastic strip, and a flexible sealing agent. The elastic strip is provided adjacent to— and preferably in contact with—an edge of the floor covering. The flexible sealing agent is provided above—and preferably on top of—the elastic strip. The flexible sealing agent is provided adjacent to and in contact with the edge of the floor covering. The combination of the elastic strip and the flexible sealing agent provide beneficial technical results. Thermal expansion of the floor covering can be compensated by a compression of the elastic strip and the flexible sealing agent above—and preferably on top of—the elastic strip. The flexible sealing agent provides, even when the floor covering thermally expands or contracts again, a watertight sealing at the edge of floor covering.

Preferably, a skirting board is positioned onto the floor panels providing the edge of the floor covering, wherein the skirting board covers the elastic strip and the flexible sealing agent.

Preferably, the elastic strip and the flexible sealing agent are provided between an edge of the floor covering and a wall, wherein the flexible sealing agent—and more preferably also the elastic strip—contacts the wall.

Preferably, the skirting board is positioned onto the wall.

Preferably, the flexible sealing agent seals the gap between the edge of the floor covering and the wall.

Preferably, the elastic strip is or comprises a flexible elastic strip or a rubber strip.

Preferably, the floor panels—and more preferably also the elastic strip is provided on a subfloor.

Preferably, the flexible sealing agent comprises or consists of silicone.

Non-limiting preferred embodiments of the invention are shown in the drawings. The embodiments illustrated in the drawings show floor coverings and floor panels.

Reference numbers not defined in the description are defined in the claims.

DETAILED DESCRIPTION OF VARIOUS EMBODIMENTS

Figure 1:
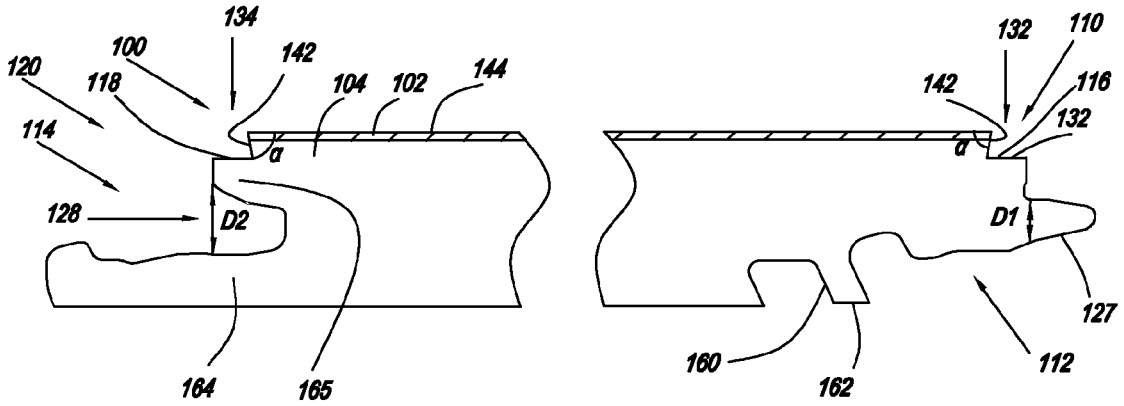
FIG. 1 shows the cross section of a first example of a floor panel that can be used in the invention.

FIG. 1 shows the cross section of a first example of an oblong floor panel that can be used in the invention. The floor covering of FIG. 2 comprises the floor panels (100) of FIG. 1. The floor panels comprise a substrate (104) and a top layer (102). The top layer comprises a decor layer and a wear layer. The decor upper surface is wear resistant and decorative. The substrate can comprise a plurality of layers.

The floor panels are provided at least at the edges (110, 120) of two opposite sides with coupling parts, cooperating which each other, substantially in the form of male coupling parts (112) and female coupling parts (114), for coupling the floor panels to each other in the floor covering. The male coupling parts and the female coupling parts are created out of material of the floor panel of the substrate.

The male coupling part is provided at the male edge (110) of the floor panels. The female coupling part is provided at the female edge (120) of the floor panels. The coupling parts are provided with integrated mechanical locking means which prevent the drifting apart of two coupled floor panels into the direction perpendicular to the surface of the floor covering and into the direction perpendicular to the respective edges in the plane of the floor covering.

The male coupling parts comprise a tongue (127) extending in horizontal direction. The female coupling parts comprise a groove (128) extending in horizontal direction. The largest thickness (D1) of the tongue is less than 70% of the largest opening (D2) of the groove. Such embodiments provide an easier coupling of the floor panels—requiring less efforts—while still good locking of the floor panels is achieved thanks to the use of the grout.

The groove (128) comprises a bottom lip (164) and an upper lip (165). The bottom lip extends over a longer distance from the edge of the floor panel than the upper lip. The contact between the coupled edges is only provided by the distal end of the bottom lip making contact with the edge of the other panel; and by the tongue making contact with the bottom surface of the upper lip (165) and with the upper surface of the bottom lip (164). In coupled condition of two panels, the bottom of the tongue makes contact with the upper surface of the bottom lip of the coupled panel at two different zones separated by a gap (161).

A symmetrical recess (130) is provided at the surface of the floor covering between two floor panels mechanically coupled to each other by the male coupling part and the female coupling part. The recess comprises a second recess (132) cut out at the male edge through the top layer. The recess can be established in alternative ways, e.g. by means of extrusion or compressive forces. The recess comprises a first recess (134) cut out at the female edge through the top layer. The recess can be established in alternative ways, e.g. by means of extrusion or compressive forces. The recess comprises an elastic grouting material (140).

The grouting material (140) is provided on a substantially horizontal surface (116) of the male coupling edge as well as on a substantially horizontal surface (118) of the female coupling edge. The substantially horizontal surfaces are provided at the bottom of the recess.

The recess has the shape of a trapezium, with the two parallel sides of the trapezium provided parallel with the floor panels; and with the longest side of the two parallel sides at the surface level of the floor. The two inclined sides of the trapezium intersect with the top surface of the floor panel. The trapezium arrangement of the recess results in it that an effective grout line can be created that effectively withstands thermal expansion and contraction of the tiles. Therefore, the grout lines are very durable.

In the example shown, the recess comprises surfaces (142) of the male edge and of the female edge having an included angle (a) with the top surface of the panel to which the edge belongs that is 80°. The surface of the male edge and of the surface of the female edge intersects with the top surface of the floor panel on which it is provided. These surfaces (142) having an included angle (a) with the top surface of the panel to which the edge belongs that is 80° create at the male edge and at the female edge an undercut having a triangular shape.

Below the recess a narrow gap (148) is provided in the substrate between the male edge and the female edge. When performing the grouting operation, grouting material flows into this narrow gap. The narrow gap is less than 0.5 mm wide; e.g. 0.3 mm. The grout that has flown into the gap creates an adhesive bond between the male edge and the female edge.

The male edge comprises a protrusion (160) directed substantially downwards. The protrusion is provided by removal of material at the bottom of the panel. However, the protrusion can be provided in different ways, e.g. via extrusion. The protrusion—which establishes the edge (174) of the panel—makes contact with the distal end (173) of the bottom lip (164) of the edge of the other panel thereby locking the panels horizontally in a flexible way. The protrusion is elastically bended. Preferably, the lower end (162) of the protrusion is provided at the same level as the bottom of the floor panels.

The bottom lip (164) comprises a first inwardly inclined contact surface (171). The bottom of the tongue comprises a second inwardly inclined contact surface (172). The first inwardly inclined contact surface (171) of the first panel contacts the second inwardly inclined contact surface (172) of the second panel coupled with the first panel, thereby establishing a locking of the first panel and the second panel in the plane of the floor covering. The contact of the first inwardly inclined contact surface (171) of the first panel with the second inwardly inclined contact surface (172) is provided by the elastic bending of the protrusion which establishes a pressure on the distal end of the distal end (173) of the bottom lip.

In horizontal direction a gap (175) is provided between the distal end of the tongue of the second panel and the proximal edge of the first panel.

Figure 3:
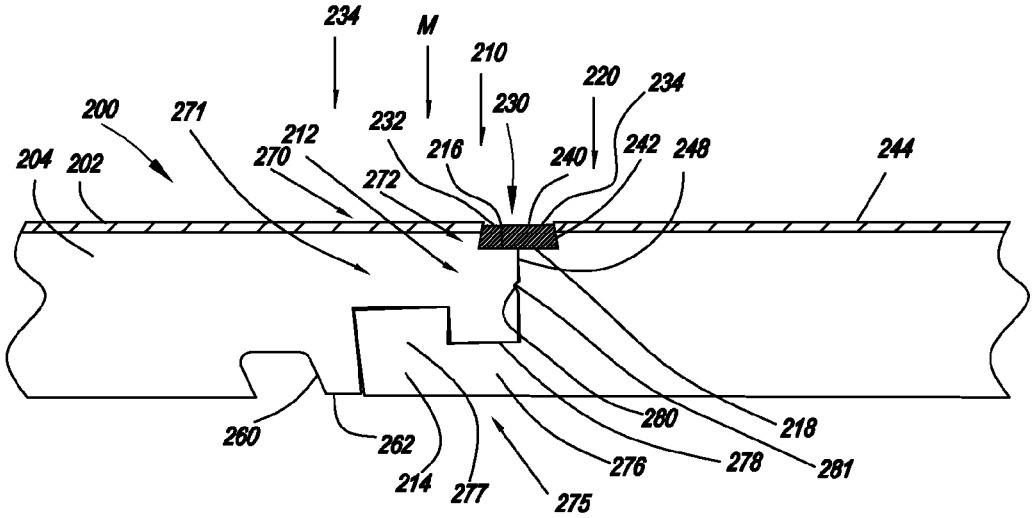
FIG. 3 shows the cross section of an alternative floor covering according to the invention.

FIG. 3 shows the cross section of an alternative floor covering according to the invention. The floor covering of FIG. 3 comprises oblong floor panels (200). The floor panels comprise a substrate (204) and a top layer (202). The top layer comprises a decor layer and a wear layer. The top layer is wear resistant and decorative, e.g. to imitate ceramic, stone, marble or other material. The decor upper surface is wear resistant and decorative. The substrate can comprise a plurality of layers.

The floor panels are provided at the edges (210, 220) of two opposite sides with coupling parts, cooperating which each other, substantially in the form of male coupling parts (212) and female coupling parts (214), for coupling floor panels to each other in the floor covering. The male coupling parts and the female coupling parts are created out of material of the substrate of the floor panel. The male coupling part is provided at the male edge (210) of the floor panels. The female coupling part is provided at the female edge (220) of the floor panels. The coupling parts are provided with integrated mechanical locking means which prevent the drifting apart of two coupled floor panels into the direction perpendicular to the surface of the floor covering and into the direction perpendicular to the respective edges in the plane of the floor covering.

The male coupling part (212) is provided by a downward-directed upper hook-shaped part (270). The downward-directed upper hook-shaped part (270) consists of a lip (271) with a downward-directed locking element (272) which forms a male part. The female coupling part (214) is provided by an upward-directed lower hook-shaped part (275). The upward-directed lower hook-shaped part consists of a lip (276) with an upward-directed locking element (277), which, proximally thereof, defines a female part in the form of a third recess (278). The male coupling part and the female coupling part are configured such that two of such floor panels can be coupled to each other at their respective edges by means of a downward movement (M) of the one floor panel in respect to the other, such that the panels are locked in the plane of the floor panels and/or perpendicular to the respective edges. The male coupling part and the female coupling part provide a vertically active locking system by means of vertically active locking parts (280, 281) of the male coupling part and of the female coupling part; this vertically active locking system creates a snap-together connection.

A symmetrical recess (230) is provided at the surface of the floor covering between two floor panels mechanically coupled to each other by the male coupling part and the female coupling part. The recess comprises a second recess (232) cut out or otherwise provided at the male edge through the top layer and extending into the substrate. The recess comprises a first recess (234) cut out at the female edge through the top layer and extending into the substrate. The recess comprises an elastic grouting material (240). The grouting material (240) is provided on a substantially horizontal surface (216) of the male coupling edge as well as on a substantially horizontal surface (218) of the female coupling edge. These substantially horizontal surfaces are provided at the bottom of the recess.

The recess (230) has the shape of a trapezium, with the two parallel sides of the trapezium provided parallel with the floor panels; and with the longest side of the two parallel sides at the surface level of the floor. This way, a very effective grout line can be created that effectively withstands thermal expansion and contraction of the tiles. Therefore, the grout line is very durable.

The recess (230) comprises surfaces (242) of the male edge and of the female edge having an included angle (a) with the top surface of the panel to which the edge belongs that is 80° The surface of the male edge and the surface of the female edge intersects with the top surface of the floor panel on which it is provided.

Below the recess a narrow gap (248) is provided in the substrate between the male edge and the female edge. When performing the grouting operation, grouting material penetrates into this gap, flowing downwards from the recess. The narrow gap is provided between vertical sections of the male edge and of the female edge; the narrow gap is e.g. 0.3 mm wide.

The male edge comprises a protrusion (260) directed substantially downwards. In the exemplary floor panels of FIG. 3, the protrusion directing substantially downwards is provided by removal of material at the bottom of the panel. However, the protrusion can be provided in other ways, e.g. by means of extrusion. The lower end (262) of the protrusion is provided at the same level as the bottom of the floor panels. The protrusion directed substantially downwards makes contact with the distal end of the other edge thereby locking the panels horizontally in a flexible way, wherein the protrusion is elastically bended; or can be elastically bended.

Figure 4:
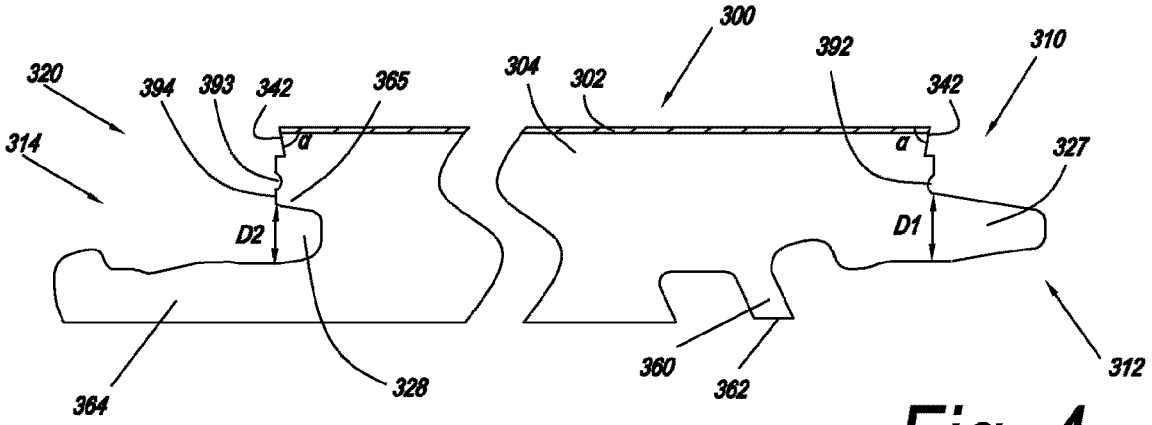
FIG. 4 shows the cross section of another example of a floor panel that can be used in the invention.

FIG. 4 shows the cross section of another example of an oblong floor panel that can be used in the invention. The floor covering of FIG. 5 comprises floor panels (300) of FIG. 4. The floor panels are to a large extent similar to the floor panels shown in FIG. 1. The floor panels comprise a substrate (304) and a top layer (302). The top layer comprises a decor layer and a wear layer. The decor upper surface is wear resistant and decorative. The substrate can comprise a plurality of layers.

The floor panels are provided at least at the edges (310, 220) of two opposite sides with coupling parts, cooperating which each other, substantially in the form of male coupling parts (312) and female coupling parts (314), for coupling the floor panels to each other in the floor covering. The male coupling parts and the female coupling parts are created out of material of the floor panel of the substrate.

The male coupling part is provided at the male edge (310) of the floor panels. The female coupling part is provided at the female edge (320) of the floor panels. The coupling parts are provided with integrated mechanical locking means which prevent the drifting apart of two coupled floor panels into the direction perpendicular to the surface of the floor covering and into the direction perpendicular to the respective edges in the plane of the floor covering.

The male coupling parts comprise a tongue (327) extending in horizontal direction. The female coupling parts comprise a groove (328) extending in horizontal direction. The largest thickness (D1) of the tongue is less than 70% of the largest opening (D2) of the groove. Such embodiments provide an easier coupling of the floor panels—requiring less efforts—while still good locking of the floor panels is achieved thanks to the use of the grout.

The groove (328) comprises a bottom lip (364) and an upper lip (365). The bottom lip extends over a longer distance from the edge of the floor panel than the upper lip. The contact between the coupled edges is only provided by the distal end of the bottom lip making contact with the edge of the other panel (more specifically with the protrusion 360); and by the tongue making contact with the bottom surface of the upper lip (365) and with the upper surface of the bottom lip (364). In coupled condition of two panels, the bottom of the tongue makes contact with the upper surface of the bottom lip of the coupled panel at two different zones separated by a gap (361).

A recess (330) is provided at the surface of the floor covering between two floor panels mechanically coupled to each other by the male coupling part and the female coupling part. The recess comprises a second recess (332) cut out at the male edge through the top layer. The recess can be established in alternative ways, e.g. by means of extrusion or compressive forces. The recess comprises a first recess (334) cut out at the female edge through the top layer. The recess can be established in alternative ways, e.g. by means of extrusion or compressive forces. The recess comprises an elastic grouting material (340).

In the example, the recess comprises surfaces (342) of the male edge and of the female edge having an included angle ($\alpha$) with the top surface of the panel to which the edge belongs that is 80°. The surface of the male edge and of the surface of the female edge intersects with the top surface of the floor panel on which it is provided.

The surfaces (342) of the male edge and of the female edge that have an included angle ($\alpha$) with the top surface of the panel to which the edge belongs that is 80°, provide an undercut in the male edge (named the first undercut) and an undercut in the female edge (called the second undercut). The first undercut as well as the second undercut have a triangular shape.

The second recess comprises a third undercut (392) in the male edge, the bottom section of the undercut is provided by the upper surface (329) of the tongue. The first recess comprises a fourth undercut (393). The third undercut and the fourth undercut have a curved shape. The fourth undercut (393) is provided above the groove (328) and is distanced from the groove (328) by a convex section (394) of the female edge (320).

The complete bottom of the recess (330) is provided in coupled condition by part of the upper surface (329) of the tongue. The grout (340) adheres to that part of the upper surface (329) of the tongue forming the bottom of the recess. The part of the upper surface of the tongue providing the bottom of the recess is provided as an inclined plane declining towards the distal end of the tongue.

In coupled condition of two floor panels an inclined section of the upper surface of the tongue (327) makes contact with an inclined section of the lower surface of the upper lip (365).

The male edge comprises a protrusion (360) directed substantially downwards. The protrusion directing substantially downwards is provided by removal of material at the bottom of the panel. However, the protrusion can be provided in different ways, e.g. via extrusion. The protrusion (360) directed substantially downwards makes contact with the distal edge of the bottom lip (364) of the other panel thereby locking the panels horizontally in a flexible way. In coupled condition, the protrusion (360) is elastically bended. Preferably, the lower end (362) of the protrusion is provided at the same level as the bottom of the floor panels.

Figure 5:
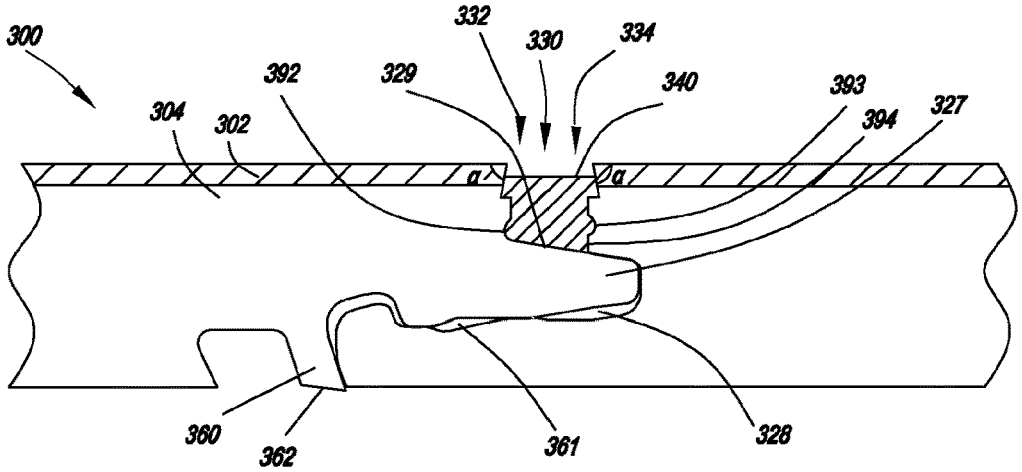
FIG. 5 shows the cross section of a floor covering according to the invention comprising floor panels of FIG. 4.
Figure 6:
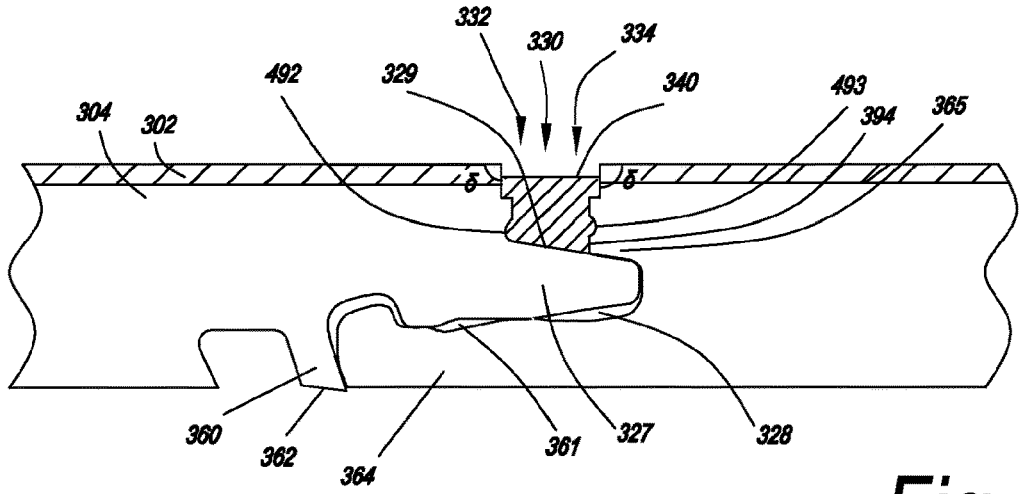
FIG. 6 shows the cross section of an alternative floor covering according to the invention.

FIG. 6 shows the cross section of an alternative floor covering according to the invention. The floor panels of FIG. 6 are to a large extent similar as the floor panels of FIGS. 4 and 5. Reference numerals in FIG. 6 have the same meaning as the same reference numerals in FIGS. 4 and 5. In the floor panels of the example of FIG. 6, the upper side edges of the recess are provided by surfaces of the male edge and of the female edge that have an included angle (δ) with the top surface of the panel that are substantially equal to 90°.

The second recess comprises a first undercut (492) in the male edge. The first recess comprises a second undercut (493) in the female edge. The first undercut (492) and the second undercut (493) have a curved edge. The bottom section of the first undercut is provided by the upper surface (329) of the tongue. The second undercut is provided above the groove (328). The second undercut (393) is distanced from the groove (328) by a convex section (394) of the female edge (320).

Figure 7:
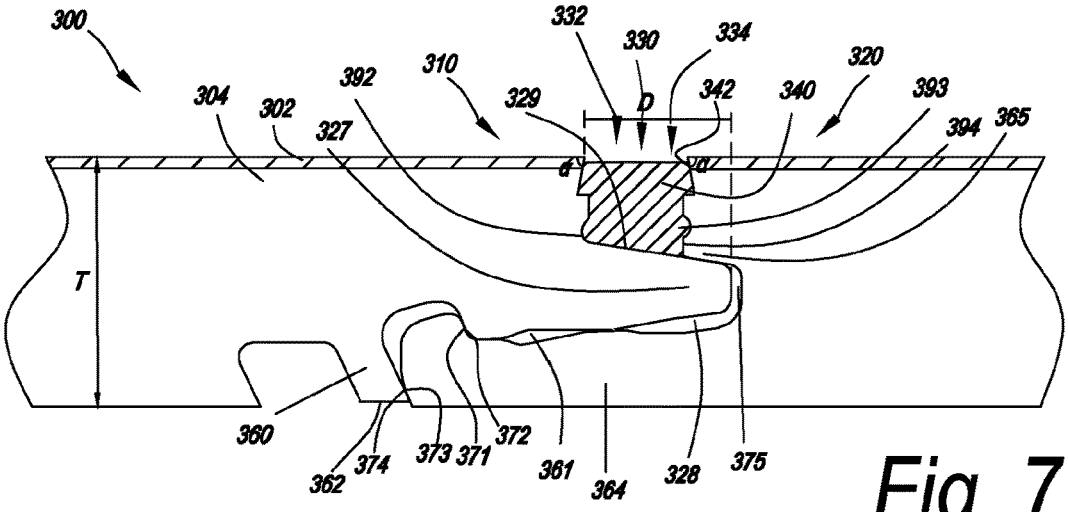
FIG. 7 shows a cross section of another floor covering according to the invention.

FIG. 7 shows a cross section of another floor covering according to the invention.

The floor panels used in the floor covering shown in FIG. 7 are to a large extent similar to the floor panels shown in FIG. 4. The floor panels (300) comprise a substrate (304) and a top layer (302). The top layer comprises a decor layer and a wear layer. The decor upper surface is wear resistant and decorative. The substrate can comprise a plurality of layers.

The floor panels are provided at least at the edges (310, 220) of two opposite sides with coupling parts, cooperating which each other, substantially in the form of male coupling parts and female coupling parts, for coupling the floor panels to each other in the floor covering. The male coupling parts and the female coupling parts are created out of material of the floor panel of the substrate.

The male coupling part is provided at the male edge (310) of the floor panels. The female coupling part is provided at the female edge (320) of the floor panels. The coupling parts are provided with integrated mechanical locking means which prevent the drifting apart of two coupled floor panels into the direction perpendicular to the surface of the floor covering and into the direction perpendicular to the respective edges in the plane of the floor covering.

The male coupling parts comprise a tongue (327) extending in horizontal direction. The female coupling parts comprise a groove (328) extending in horizontal direction. The largest thickness of the tongue is less than 70% of the largest opening of the groove. Such embodiments provide an easier coupling of the floor panels—requiring less efforts—while still good locking of the floor panels is achieved thanks to the use of the grout.

The groove (328) comprises a bottom lip (364) and an upper lip (365). The bottom lip extends over a longer distance from the edge of the floor panel than the upper lip. The bottom lip (364) comprises a first inwardly inclined contact surface (371). The bottom of the tongue comprises a second inwardly inclined contact surface (372). The first inwardly inclined contact surface (371) of the first panel contacts the second inwardly inclined contact surface (372) of the second panel coupled with the first panel, thereby establishing a locking of the first panel and the second panel in the plane of the floor covering.

The male edge comprises a protrusion (360) directed substantially downwards. The protrusion is provided by removal of material at the bottom of the panel. However, the protrusion can be provided in different ways, e.g. via extrusion. The protrusion—which establishes the edge (374) of the panel—makes contact with the distal end (373) of the bottom lip (364) of the edge of the other panel thereby locking the panels horizontally in a flexible way. The protrusion is elastically bended. Preferably, the lower end (362) of the protrusion is provided at the same level as the bottom of the floor panels.

The bottom lip (364) comprises a first inwardly inclined contact surface (371). The bottom of the tongue comprises a second inwardly inclined contact surface (372). The first inwardly inclined contact surface (371) of the first panel contacts the second inwardly inclined contact surface (372) of the second panel coupled with the first panel, thereby establishing a locking of the first panel and the second panel in the plane of the floor covering. The contact of the first inwardly inclined contact surface (371) of the first panel with the second inwardly inclined contact surface (372) is provided by the elastic bending of the protrusion which establishes a pressure on the distal end of the distal end (373) of the bottom lip.

In horizontal direction a gap (375) is provided between the distal end of the tongue (327) of the second panel and the proximal edge of the first panel.

The contact between the coupled edges is only provided by the distal end of the bottom lip making contact with the edge of the other panel (more specifically with the protrusion 360); and by the tongue making contact with the bottom surface of the upper lip (365) and with the upper surface of the bottom lip (364). The contact of the tongue making contact with the upper surface of the bottom lip (364) includes the contact between the first inwardly inclined contact surface (371) and the second inwardly inclined contact surface (372).

In coupled condition of two panels, the bottom of the tongue (327) makes contact with the upper surface of the bottom lip of the coupled panel at two different zones separated by a gap (361).

A recess (330) is provided at the surface of the floor covering between two floor panels mechanically coupled to each other by the male coupling part and the female coupling part. The recess comprises a second recess (332) cut out at the male edge through the top layer. The recess can be established in alternative ways, e.g. by means of extrusion or compressive forces. The recess comprises a first recess (334) cut out at the female edge through the top layer. The recess can be established in alternative ways, e.g. by means of extrusion or compressive forces. The recess comprises an elastic grouting material (340).

In the example, the recess comprises surfaces (342) of the male edge and of the female edge having an included angle (α) with the top surface of the panel to which the edge belongs that is 80°. The surface of the male edge and of the surface of the female edge intersects with the top surface of the floor panel on which it is provided.

The surfaces (342) of the male edge and of the female edge that have an included angle (α) with the top surface of the panel to which the edge belongs that is 80°, provide an undercut in the male edge (named the first undercut) and an undercut in the female edge (called the second undercut). The first undercut as well as the second undercut have a triangular shape.

The second recess comprises a third undercut (392) in the male edge, the bottom section of the undercut is provided by the upper surface (329) of the tongue. The first recess comprises a fourth undercut (393). The third undercut and the fourth undercut have a curved shape. The fourth undercut (393) is provided above the groove (328) and is distanced from the groove (328) by a convex section (394) of the female edge (320).

The complete bottom of the recess (330) is provided in coupled condition by part of the upper surface (329) of the tongue. The grout (340) adheres to that part of the upper surface (329) of the tongue forming the bottom of the recess. The part of the upper surface of the tongue providing the bottom of the recess is provided as an inclined plane declining towards the distal end of the tongue.

In coupled condition of two floor panels an inclined section of the upper surface of the tongue (327) makes contact with an inclined section of the lower surface of the upper lip (365).

The ratio of the horizontal distance D over which the tongue (327) extends in horizontal direction from the top surface of the panel edge on which the tongue is provided, over the thickness T of the floor panels is 0.58.

Figure 8:
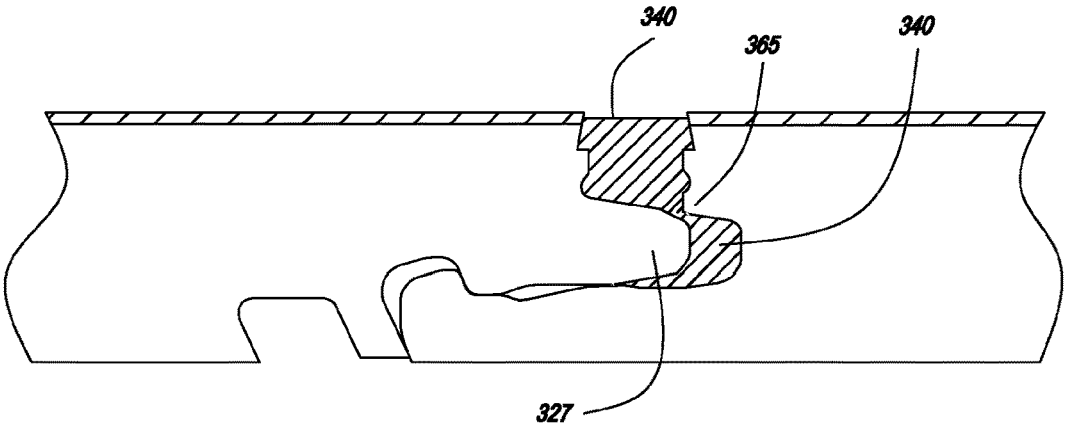
FIG. 8 shows a cross section at a particular position of another floor covering according to the invention.

The panels used in the floor covering shown in FIG. 7 can have a constant cross section along their edges. However, the invention involves embodiments wherein in a first section along the edge comprising the male coupling parts, the tongue (327) is configured such that it contacts the bottom surface of the upper lip (365) of the coupled panel; and wherein in at least a second section along the edge comprising the male coupling parts, the tongue (327) is configured such that it does not contact the bottom surface of the upper lip (365) of the coupled panel. FIGS. 7 and 8 in combination illustrate such embodiment. FIG. 7 shows the cross section perpendicularly to the male edge at both end sections along the male edge, showing that the tongue (327) contacts the bottom surface of the upper lip (365). FIG. 8 shows the cross section perpendicularly to the male ends at other sections along the male edges; the tongue (327) in these sections does not contact the bottom surface of the upper lip (365). As there is no contact in these sections between the tongue and the bottom surface of the upper lip (365), grouting material (340) can flow in gaps provided at the distal end of the tongue and under the tongue, reinforcing the durability of the grouted floor covering. The difference between the cross sections of FIGS. 7 and 8 is provided by the configuration of the tongue, involving differences in the distance over which the tongue (327) extends from the panel edge.

Figure 9:
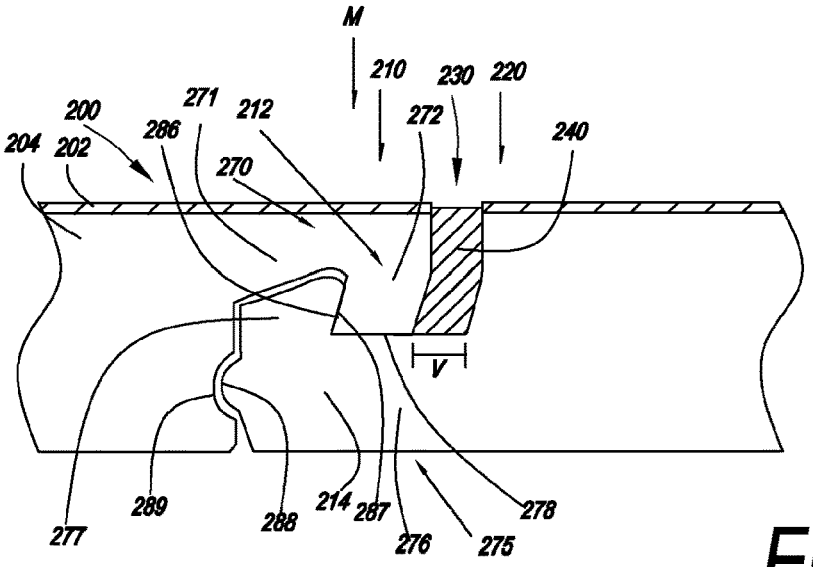
FIG. 9 shows the cross section of a floor covering according to the invention.

FIG. 9 shows the cross section of a floor covering according to the invention. The floor covering of FIG. 9 comprises oblong floor panels (200). The floor panels comprise a substrate (204) and a top layer (202). The top layer comprises a decor layer and a wear layer. The top layer is wear resistant and decorative, e.g. to imitate ceramic, stone, marble or other material. The decor upper surface is wear resistant and decorative. The substrate can comprise a plurality of layers.

The floor panels are provided at the edges (210, 220) of two opposite sides with coupling parts, cooperating which each other, substantially in the form of male coupling parts (212) and female coupling parts (214), for coupling floor panels to each other in the floor covering. The male coupling parts and the female coupling parts are created out of material of the substrate of the floor panel. The male coupling part is provided at the male edge (210) of the floor panels. The female coupling part is provided at the female edge (220) of the floor panels. The coupling parts are provided with integrated mechanical locking means which prevent the drifting apart of two coupled floor panels into the direction perpendicular to the surface of the floor covering and into the direction perpendicular to the respective edges in the plane of the floor covering.

The male coupling part (212) is provided by a downward-directed upper hook-shaped part (270). The downward-directed upper hook-shaped part (270) consists of a lip (271) with a downward-directed locking element (272) which forms a male part. The female coupling part (214) is provided by an upward-directed lower hook-shaped part (275). The upward-directed lower hook-shaped part consists of a lip (276) with an upward-directed locking element (277), which, proximally thereof, defines a female part in the form of a third recess (278). The male coupling part and the female coupling part are configured such that two of such floor panels can be coupled to each other at their respective edges by means of a downward movement (M) of the one floor panel in respect to the other, such that the panels are locked in the plane of the floor panels and perpendicular to the respective edges.

The proximal end of the downward-directed locking element (272) comprises a first inclined contact surface (286). The proximal end of the upward-directed locking element (277) comprises a second inclined contact surface (287). In coupled condition of a first floor panel at the edge comprising the downward-directed locking element (272), its first inclined contact surface (286) contacts the second inclined contact surface (287) of the panel with which the first panel is coupled at the edge comprising the downward-directed locking element (272); thereby establishing a locking of the coupled panels in vertical direction.

The distal end of the upward-directed upper hook-shaped part (275) comprises a locking part (288), for cooperation with a locking part (289) at the proximal end of the downward-directed upper hook-shaped part (270) of a coupled panel, thereby establishing a locking of the coupled panels in vertical direction. In the example shown, this locking does not involve contact of the locking part (288) of the upward-directed upper hook-shaped part (275) with the locking part (289) at the proximal end of the downward-directed upper hook-shaped part (270) of the coupled panel.

In coupled condition of the downward-directed upper hook-shaped part (270) of a first panel with the upward-directed lower hook-shaped part (275) of a second panel, the bottom of the downward-directed locking element (272) of the first panel contacts the lip (276) of the upward-directed lower hook-shaped part (275) of the second panel.

In coupled condition of the downward-directed upper hook-shaped part (270) of a first panel with the upward-directed lower hook-shaped part (275) of a second panel, the lower surface of the lip (271) of the downward-directed upper hook-shaped part (270) of the first panel does not contact the upper surface of the upward-directed locking element (277) of the second panel.

A recess (230) is provided at the surface of the floor covering between two floor panels mechanically coupled to each other by the male coupling part and the female coupling part. The recess comprises an elastic grouting material (240). The floor panels are configured such that the recess extends to a part of the upper surface of the lip (276) of the upward-directed lower hook-shaped part (275). This way, grouting material (240) is provided on and adheres to part of the upper surface of the lip (276) of the upward-directed lower hook-shaped part (275). The width V of the recess at the upper surface of the lip (276) of the upward-directed lower hook-shaped part (275) is e.g. 2 mm.

Figure 2:
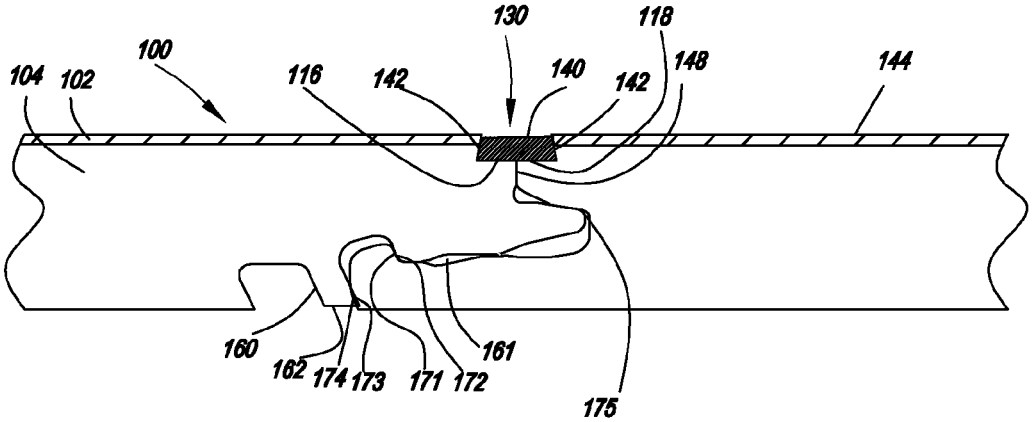
FIG. 2 shows the cross section of a floor covering according to the invention comprising floor panels of FIG. 1.

The arrangement of the male and female edges shown in FIGS. 1 and 2 or shown in FIGS. 4 and 5 or 6 or 7 or 8, can be provided at first opposed edges of rectangular, square or oblong, floor panels. The arrangement of the male and female edges shown in FIG. 3 or 9 can be provided at the second opposed edges of these square or oblong floor panels. Floor coverings made with such floor panels can be mechanically coupled at all four sides using the relevant male and female coupling parts. These floor coverings show recesses around all four sides of the floor panels of the floor covering, filled with grouting material.

The arrangement of the male and female edges shown in FIGS. 1 and 2 or shown in FIGS. 4 and 5; or 6 or 7 or 8, can be provided at first opposed edges of rectangular, square or oblong, floor panels, as well as at second opposed edges of rectangular, square or oblong, floor panels. Floor coverings made with such floor panels can be mechanically coupled at all four sides using the relevant male and female coupling parts. These floor coverings show recesses around all four sides of the floor panels of the floor covering, filled with grouting material.

The arrangement of the male and female edges according to "double hook" embodiments, e.g. as shown in FIGS. 3 and 9 can be provided at first opposed edges of rectangular, square or oblong, floor panels, as well as at second opposed edges of rectangular, square or oblong, floor panels. Floor coverings made with such floor panels can be mechanically coupled at all four sides using the relevant male and female coupling parts. These floor coverings show recesses around all four sides of the floor panels of the floor covering, filled with grouting material.

Figure 10:
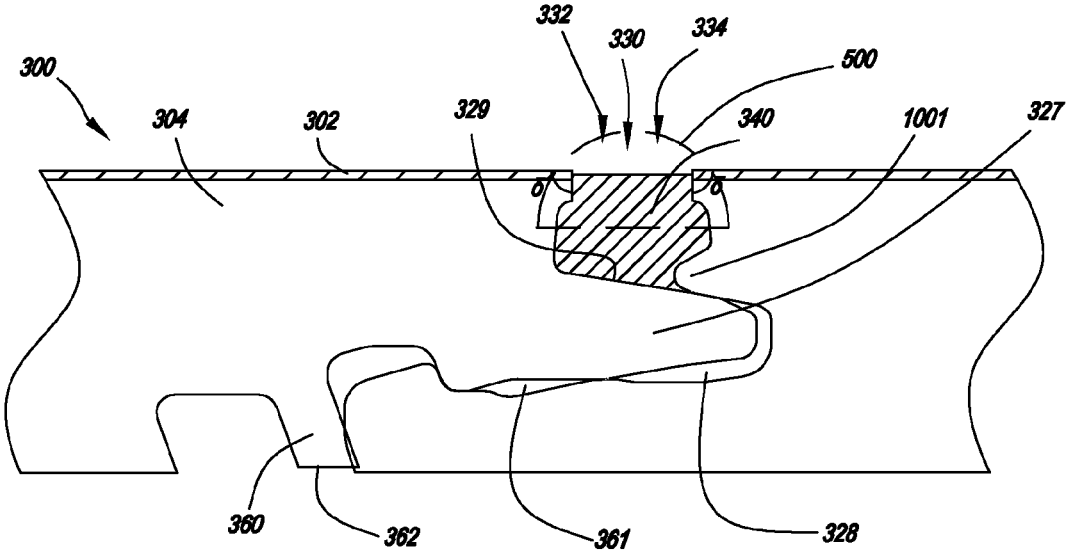
FIG. 10 shows the cross section of an alternative floor covering according to the invention.

FIG. 10 shows the cross section of an alternative floor covering according to the invention. The floor covering is to a large extent similar to the floor covering shown in FIG. 6. The reference numerals in FIG. 10 have the same meaning as the reference numerals in FIGS. 4, 5 and 6. The coupling parts of the panels of the floor covering of FIG. 10 are configured such that when installing the covering, a panel can be coupled via a turning movement of the panel relative to an already installed panel, wherein the male coupling part of the male edge of the panel is inserted into the female coupling part of the female edge of the already installed panel. Furthermore, the coupling parts of the panels of the floor covering of FIG. 10 are configured such that when installing the covering, a panel can be coupled via a substantially horizontal sliding movement with snap effect of the panel relative to an already installed panel, wherein the male coupling part of the male edge of the panel is inserted into the female coupling part of the female edge of the already installed panel with a snap effect.

The female edge of the panels of the embodiment shown in FIG. 10 comprises a rounded nose (1001) above the groove (328). Especially the rounding at the bottom of the nose assists the installation and coupling of the panels via a substantially horizontal sliding movement with snap effect. Grouting material (340) contacts and adheres to the upper section of the nose (1001), as well as to the bottom section of the nose (1001). the rounding at the bottom of the nose (1001) guides the tongue (327) of the panel to be installed correctly into the groove (328) during the substantially horizontal sliding movement with snap effect.

Figure 20:
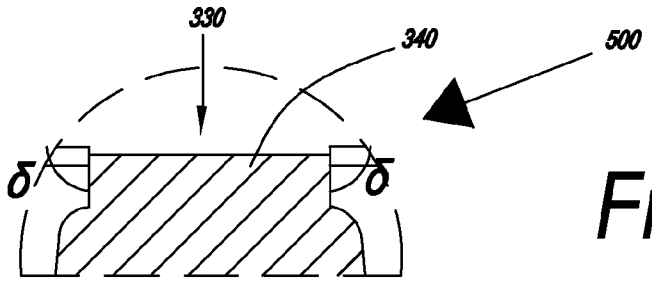
FIGS. 20-26 show details of features that can be used in the invention.

A detail (500) of the floor covering shown in FIG. 10 is shown enlarged in FIG. 20.

Figure 11:
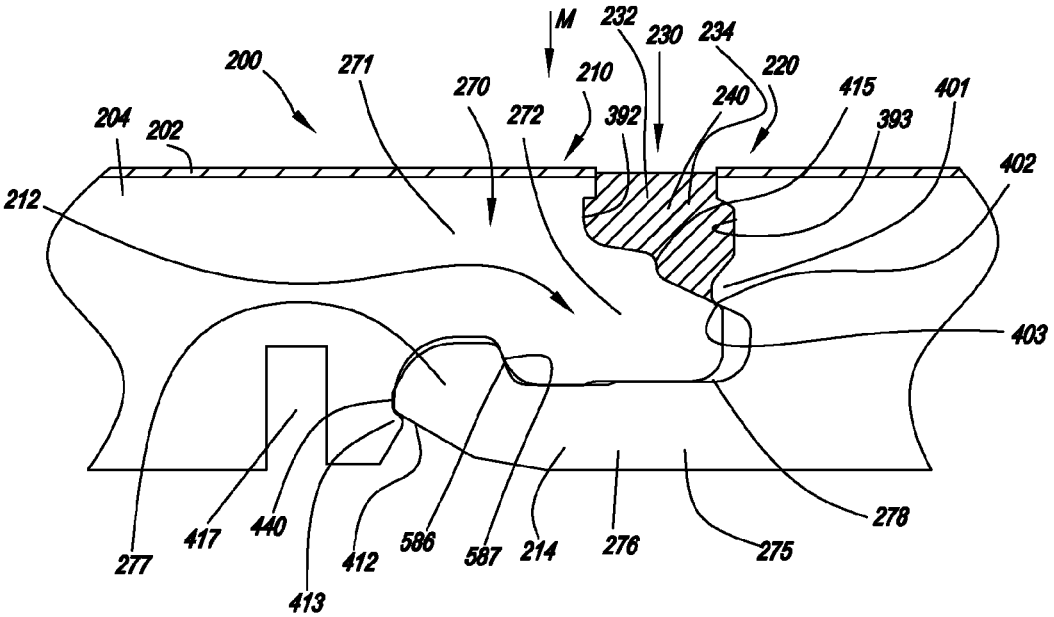
FIGS. 11-18 show the cross section of other examples of floor coverings according to aspects of the invention.

FIG. 11 shows the cross section of yet another example of floor covering according to aspects of the invention. FIG. 11 shows a floor covering comprising floor or wall panels (200). The panels comprise a substrate (204) and a top layer (202). The top layer comprises a decor layer; and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and/or into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a first recess (234) cut out or otherwise provided at the female edge, through the top layer and extending into the substrate; and a second recess (232) cut out or otherwise provided at the male edge through the top layer and extending into the substrate.

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges. The recess (230) comprises a grouting material (240).

In coupled condition of the male coupling part (212) of a panel with the female coupling part (214) of another panel, a locking in vertical direction is provided at the distal end of the downward-directed locking element (272) of the panel. A nose (401) extends from the proximal end of the edge comprising the female coupling part. The nose interacts with the downward-direct locking element (272) of the coupled panel, thereby providing a locking in vertical direction at the distal end of the downward-directed locking element (272). The vertical locking at the distal end of the downward directed locking element (272) is established at inclined surfaces (402, 403) of the nose (401) and of the downward-directed locking element (272). In the example shown, in coupled condition the inclined surfaces (402, 403) are in contact with pretension.

The grouting material (240) contacts the upper part of the nose (401). The grouting material (240) contacts part of the upper surface of the downward-directed locking element (272). The male edge and the female edge each comprise an undercut (392, 393), wherein each of these undercuts comprise grouting material.

No vertical locking is provided between coupled panels at the proximal end of the upward-directed locking element (277) nor at the proximal end of the downward-directed locking element (272). However, the proximal end of the upward-directed locking element (277) contacts the proximal end of the downward-directed locking element (272) with pretension at their contact surfaces (586, 587).

In coupled condition of the male edge of a panel with the female edge of another panel, a locking in vertical direction is provided at the distal end of the upward-directed locking element (277). The distal end of the upward-directed locking element (277) comprises an undercut (412). The panels comprise at the proximal edge of their male edge a corresponding hook (413). The corresponding hook (413) is provided for interacting with the upward-directed locking element (277) of a coupled panel for establishing a locking in vertical direction.

The bottom surface of the undercut is provided for establishing a locking in vertical direction. In the example shown in FIG. 11, the upward-directed locking element (277) contacts the proximal edge of the panel with which it is coupled at the distal end of the upward-directed locking element (277). The distal end of the upward-directed locking element (277) comprises an undercut (412) and the upward-directed locking element (277) contacts the proximal edge of the panel with which it is coupled at the undercut of the upward-directed locking element (277).

This also results in a locking in horizontal direction (440) between neighboring panels provided by contact between coupled panels at the distal end of the downward-directed locking element (277).

The panels of the embodiment shown in FIG. 11 can be installed at their first set of opposite edges via a vertical push or drop movement (M), but also via a turning movement of a panel relative to an already installed panel, wherein the male coupling part of the male edge is inserted into the female coupling part of the female edge of the already installed panel; and also via a substantially horizontal sliding movement with snap effect of a panel relative to an already installed panel, wherein the male coupling part of the male edge is inserted into the female coupling part of the female edge of the already installed panel with a snap effect.

The panels of the embodiment shown in FIG. 11 are configured such that at least before applying the grouting material to the covering, a panel can be removed from the covering via a turning movement of one panel with respect of another panel, wherein the male coupling part of the male edge is removed out of the female coupling part of the female edge of the another panel.

The upper surface of the downward-directed locking element (272) comprises a step (415). The grouting material contacts the step (415).

A cut (417) is provided in the panels extending from the bottom of the panel. The cut (417) is provided proximal to the male edge of the panel; the cut (417) extends from the bottom of the panel into the panel for more than 30% of the thickness of the panel. In the example of FIG. 11 the cut (417) extends perpendicularly to the bottom of the panel.

The panels shown in the embodiment of FIG. 11 can be rectangular, square or oblong. They can be provided at the second set of opposite edges with coupling parts as in any embodiment of any aspect of the invention.

Figure 12:
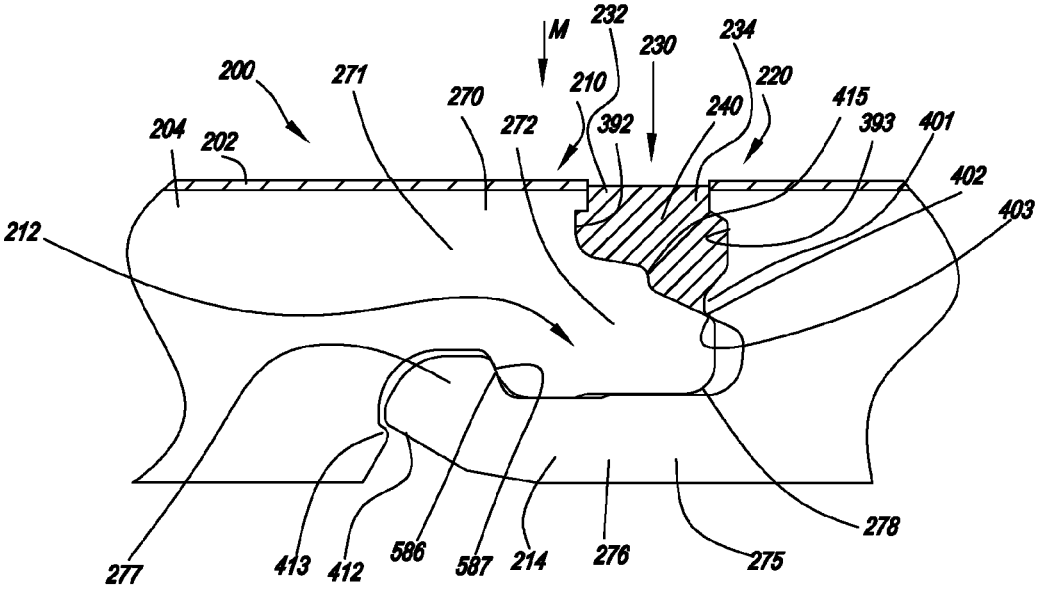

FIG. 12 shows the cross section of yet another example of floor covering according to aspects of the invention. FIG. 12 shows a floor covering comprising floor or wall panels (200). The panels comprise a substrate (204) and a top layer (202). The top layer comprises a decor layer; and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a first recess (234) cut out or otherwise provided at the female edge, through the top layer and extending into the substrate; and a second recess (232) cut out or otherwise provided at the male edge through the top layer and extending into the substrate.

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges.

The recess (230) comprises a grouting material (240).

In coupled condition of the male coupling part (212) of a panel with the female coupling part (214) of another panel, a locking in vertical direction is provided at the distal end of the downward-directed locking element (272) of the panel. A nose (401) extends from the proximal end of the edge comprising the female coupling part. The nose interacts with the downward-direct locking element (272) of the coupled panel, thereby providing a locking in vertical direction at the distal end of the downward-directed locking element (272). The vertical locking at the distal end of the downward directed locking element (272) is established at inclined surfaces (402, 403) of the nose (401) and of the downward-directed locking element (272); preferably wherein in coupled condition the inclined surfaces are in contact with pretension.

The grouting material (240) contacts the upper part of the nose (401). The grouting material (240) contacts part of the upper surface of the downward-directed locking element (272). The male edge and the female edge each comprise an undercut (392, 393), wherein each of these undercuts comprise grouting material. The upper surface of the downward-directed locking element (272) comprises a step (415). The grouting material contacts the step (415).

No vertical locking is provided between coupled panels at the proximal end of the upward-directed locking element (277) nor at the proximal end of the downward-directed locking element (272). However, the proximal end of the upward-directed locking element (277) contacts the proximal end of the downward-directed locking element (272) with pretension at their contact surfaces (586, 587).

In coupled condition of the male edge of a panel with the female edge of another panel, a locking in vertical direction is provided at the distal end of the upward-directed locking element (277) without contact. The distal end of the upward-directed locking element (277) comprises an undercut (412). The panels comprise at the proximal edge of their male edge a corresponding hook (413). The corresponding hook (413) is provided for interacting with the upward-directed locking element (277) of a coupled panel for establishing a locking in vertical direction. This locking in FIG. 12 is provided without contact between the distal end of the upward-directed locking element (277) and the corresponding hook (413).

The panels of the embodiment shown in FIG. 12 can be installed at their first set of opposite edges via a vertical drop or push movement (M), but also via a turning movement of a panel relative to an already installed panel, wherein the male coupling part of the male edge is inserted into the female coupling part of the female edge of the already installed panel; and also via a substantially horizontal sliding movement with snap effect of a panel relative to an already installed panel, wherein the male coupling part of the male edge is inserted into the female coupling part of the female edge of the already installed panel with a snap effect.

The panels of the embodiment shown in FIG. 112 are configured such that at least before applying the grouting material to the covering, a panel can be removed from the covering via a turning movement of one panel with respect of another panel, wherein the male coupling part of the male edge is removed out of the female coupling part of the female edge of the another panel.

The panels shown in the embodiment of FIG. 12 can be rectangular, square or oblong. They can be provided at the second set of opposite edges with coupling parts as in any embodiment of any aspect of the invention.

Figure 13:
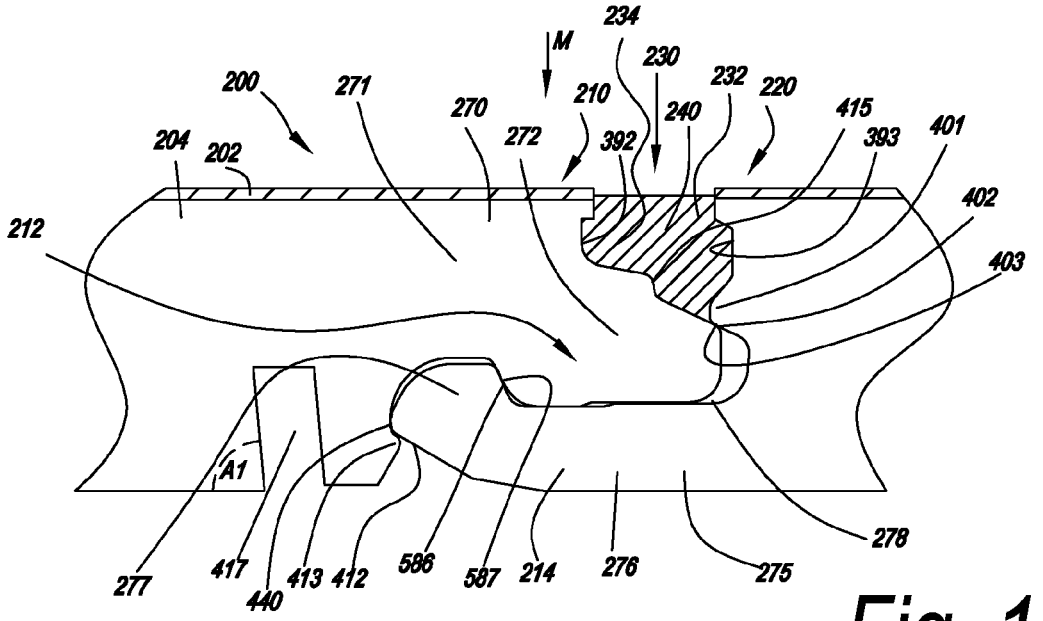

FIG. 13 shows the cross section of yet another example of floor covering according to aspects of the invention. The embodiment shown in FIG. 13 is to a very large extent similar to the embodiment shown in FIG. 11. Reference numbers in FIG. 13 have the same meaning as in FIG. 11. The embodiment in FIG. 13 differs from the embodiment of FIG. 11 in that the cut (417) makes an angle 85° with the bottom of the panels. The cut (417) extends towards the distal end comprising the male edge when observed from the inside of the panel towards the bottom of the panel. This way, milling of the coupling parts is facilitated, as the milling tools can be positioned closer to the chains of the continuous milling machine which is used. Closer positioning of the milling tools to the chains of the continuous milling machines enables to achieve narrower milling tolerances.

Figure 14:
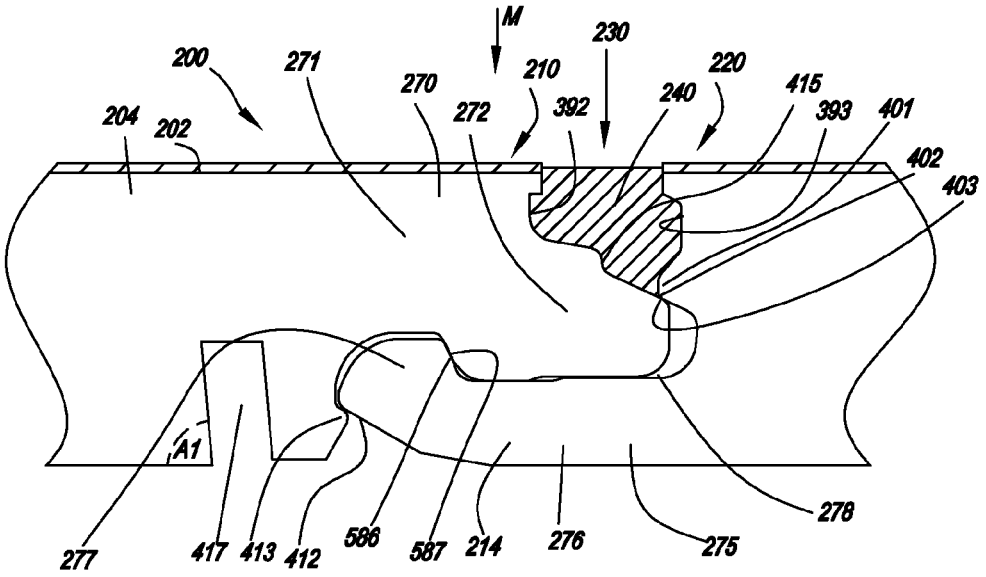

FIG. 14 shows the cross section of yet another example of floor covering according to aspects of the invention. The embodiment shown in FIG. 14 is to a very large extent similar to the embodiment shown in FIG. 12. Reference numbers in FIG. 14 have the same meaning as in FIG. 12. As in FIG. 12, a cut (417) is provided in the panels extending from the bottom of the panel. The cut (417) is provided proximal to the male edge of the panel and extends from the bottom of the panel into the panel for more than 30% of the thickness of the panel. In the example of FIG. 14 the cut (417) makes an angle 85° with the bottom of the panels. The cut (417) extends towards the distal end comprising the male edge when observed from the inside of the panel towards the bottom of the panel. This way, milling of the coupling parts is facilitated, as the milling tools can be positioned closer to the chains of the continuous milling machine which is used. Closer positioning of the milling tools to the chains of the continuous milling machines enables to achieve narrower milling tolerances.

Figure 15:
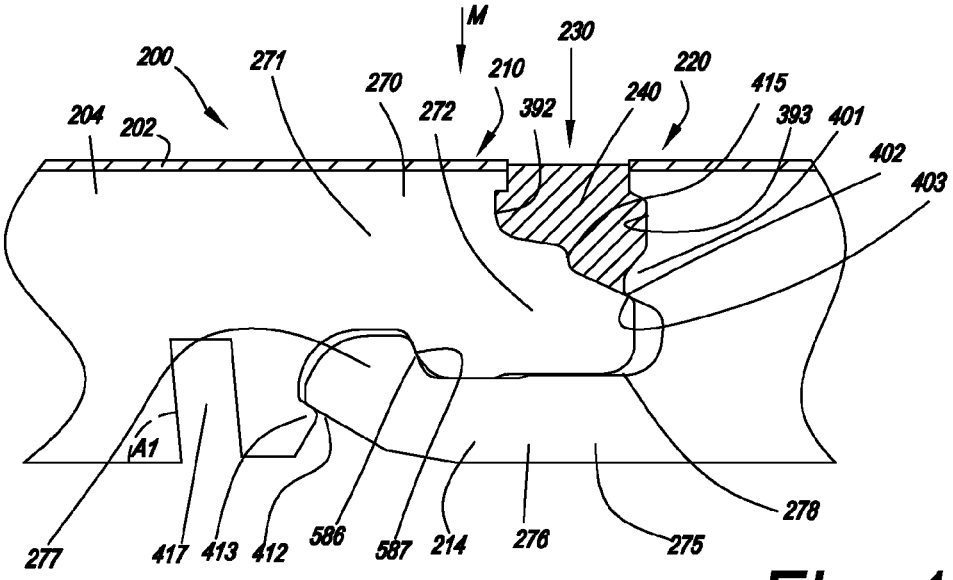

FIG. 15 shows the cross section of yet another example of floor covering according to aspects of the invention. FIG. 15 shows a floor covering comprising floor or wall panels (200). The panels comprise a substrate (204) and a top layer (202). The top layer comprises a decor layer, and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a first recess (234) cut out or otherwise provided at the female edge, through the top layer and extending into the substrate; and a second recess (232) cut out or otherwise provided at the male edge through the top layer and extending into the substrate.

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges.

The recess (230) comprises a grouting material (240). The upper surface of the downward-directed locking element (272) comprises a step (415). The grouting material contacts the step (415).

In coupled condition of the male coupling part (212) of a panel with the female coupling part (214) of another panel, a locking in vertical direction is provided at the distal end of the downward-directed locking element (272) of the panel. A nose (401) extends from the proximal end of the edge comprising the female coupling part. The nose interacts with the downward-direct locking element (272) of the coupled panel, thereby providing a locking in vertical direction at the distal end of the downward-directed locking element (272). The vertical locking at the distal end of the downward directed locking element (272) is established at inclined surfaces (402, 403) of the nose (401) and of the downward-directed locking element (272); preferably wherein in coupled condition the inclined surfaces are in contact with pretension.

The grouting material (240) contacts the upper part of the nose (401). The grouting material (240) contacts part of the upper surface of the downward-directed locking element (272). The male edge and the female edge each comprise an undercut (392, 393), wherein each of these undercuts comprise grouting material.

No vertical locking is provided between coupled panels at the proximal end of the upward-directed locking element (277) nor at the proximal end of the downward-directed locking element (272). However, the proximal end of the upward-directed locking element (277) contacts the proximal end of the downward-directed locking element (272) with pretension at their contact surfaces (586, 587).

In coupled condition of the male edge of a panel with the female edge of another panel, a locking in vertical direction is provided at the distal end of the upward-directed locking element (277). The distal end of the upward-directed locking element (277) comprises an undercut (412). The panels comprise at the proximal edge of their male edge a corresponding hook (413). The bottom surface of the undercut (412) contacts the corresponding hook (413), thereby establishing a locking in vertical direction.

The panels of the embodiment shown in FIG. 15 can be installed at their first set of opposite edges via a vertical drop or push movement (M), but also via a turning movement of a panel relative to an already installed panel, wherein the male coupling part of the male edge is inserted into the female coupling part of the female edge of the already installed panel; and also via a substantially horizontal sliding movement with snap effect of a panel relative to an already installed panel, wherein the male coupling part of the male edge is inserted into the female coupling part of the female edge of the already installed panel with a snap effect.

The panels of the embodiment shown in FIG. 15 are configured such that at least before applying the grouting material to the covering, a panel can be removed from the covering via a turning movement of one panel with respect of another panel, wherein the male coupling part of the male edge is removed out of the female coupling part of the female edge of the another panel.

A cut (417) is provided in the panels extending from the bottom of the panel. The cut (417) is provided proximal to the male edge of the panel; the cut (417) extends from the bottom of the panel into the panel for more than 30% of the thickness of the panel. In the example of FIG. 15 the cut (417) makes an angle 85° with the bottom of the panels. The cut (417) extends towards the distal end comprising the male edge when observed from the inside of the panel towards the bottom of the panel.

The panels shown in the embodiment of FIG. 15 can be rectangular, square or oblong. They can be provided at the second set of opposite edges with coupling parts as in any embodiment of any aspect of the invention.

Figure 16:
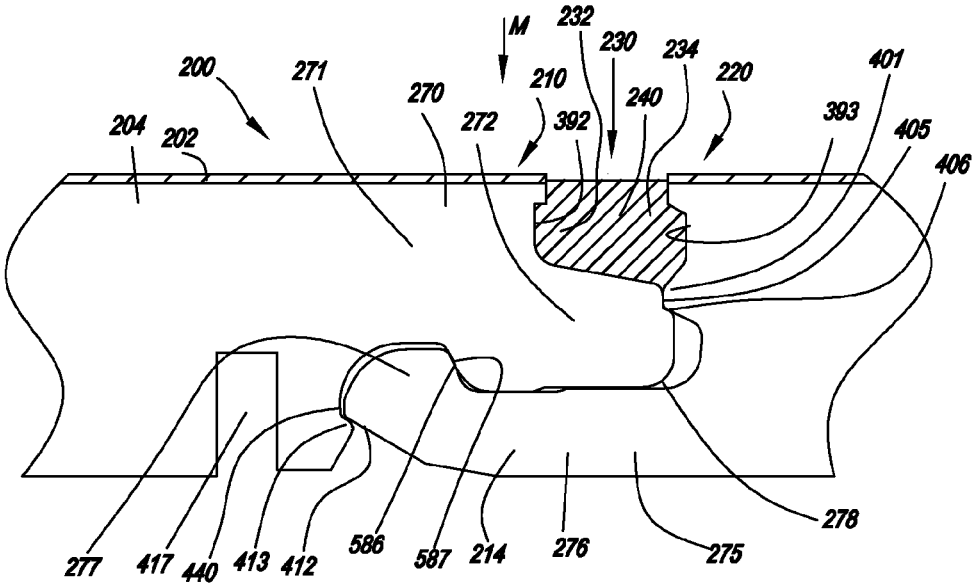

FIG. 16 shows the cross section of yet another example of floor covering according to aspects of the invention. FIG. 16 shows a floor covering comprising floor or wall panels (200). The panels comprise a substrate (204) and a top layer (202). The top layer comprises a decor layer, and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and/or into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a first recess (234) cut out or otherwise provided at the female edge, through the top layer and extending into the substrate; and a second recess (232) cut out or otherwise provided at the male edge through the top layer and extending into the substrate. The recess (230) comprises a grouting material (240).

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges.

In coupled condition of the male coupling part (212) of a panel with the female coupling part (214) of another panel, a locking in vertical direction is provided at the distal end of the downward-directed locking element (272) of the panel.

A nose (401) extends from the proximal end of the edge comprising the female coupling part. The nose (401) interacts with the downward-direct locking element (272) of the coupled panel, thereby providing a locking in vertical direction at the distal end of the downward-directed locking element (272).

The nose (401) of the first of the coupled panels establishes a first contact surface (405) with the female edge of the second of the coupled panels and a second contact surface (406) with the female edge of the second of the coupled panels. The first contact surface (405) is perpendicular to the surface of the coupled panels, thereby establishing a locking in horizontal direction of the coupled panels and properly defining the width of the recess (230) in which grout is provided.

The second contact surface (406) makes—in the example of FIG. 16—an angle −25° with the surface of the coupled panels, thereby establishing a locking in the direction perpendicular to the surface of the coupled panels.

The grouting material (240) contacts the upper part of the nose (401). The grouting material (240) contacts part of the upper surface of the downward-directed locking element (272). The male edge and the female edge each comprise an undercut (392, 393), wherein each of these undercuts comprise grouting material (240).

No vertical locking is provided between coupled panels at the proximal end of the upward-directed locking element (277) nor at the proximal end of the downward-directed locking element (272). However, the proximal end of the upward-directed locking element (277) contacts the proximal end of the downward-directed locking element (272) with pretension at their contact surfaces (586, 587).

In coupled condition of the male edge of a panel with the female edge of another panel, a locking in vertical direction is provided at the distal end of the upward-directed locking element (277). The distal end of the upward-directed locking element (277) comprises an undercut (412). The panels comprise at the proximal edge of their male edge a corresponding hook (413). The corresponding hook (413) is provided for interacting with the upward-directed locking element (277) of a coupled panel for establishing a locking in vertical direction.

The bottom surface of the undercut is provided for establishing a locking in vertical direction. In the example shown in FIG. 16, the upward-directed locking element (277) contacts the proximal edge of the panel with which it is coupled at the distal end of the upward-directed locking element (277) and wherein the distal end of the upward-directed locking element (277) comprises an undercut (412) and the upward-directed locking element (277) contacts the proximal edge of the panel with which it is coupled at the undercut of the upward-directed locking element (277).

This also results in a locking in horizontal direction (440) between neighboring panels provided by contact between coupled panels at the distal end of the downward-directed locking element (277).

The panels of the embodiment shown in FIG. 16 can be installed at their first set of opposite edges via a vertical drop or push movement (M), but also via a turning movement of a panel relative to an already installed panel, wherein the male coupling part of the male edge is inserted into the female coupling part of the female edge of the already installed panel; and also via a substantially horizontal sliding movement with snap effect of a panel relative to an already installed panel, wherein the male coupling part of the male edge is inserted into the female coupling part of the female edge of the already installed panel with a snap effect.

The panels of the embodiment shown in FIG. 16 are configured such that at least before applying the grouting material to the covering, a panel can be removed from the covering via a turning movement of one panel with respect of another panel, wherein the male coupling part of the male edge is removed out of the female coupling part of the female edge of the another panel.

A cut (417) is provided in the panels extending from the bottom of the panel. The cut (417) is provided proximal to the male edge of the panel; the cut (417) extends from the bottom of the panel into the panel for more than 30% of the thickness of the panel. In the example of FIG. 16 the cut (417) extends perpendicularly to the bottom of the panel.

The panels shown in the embodiment of FIG. 16 can be rectangular, square or oblong. They can be provided at the second set of opposite edges with coupling parts as in any embodiment of any aspect of the invention.

Figure 17:
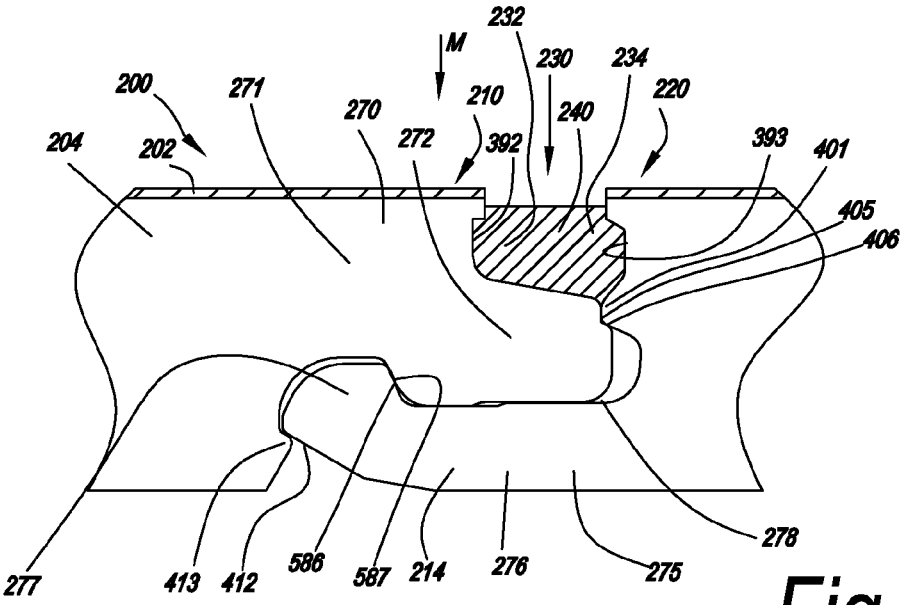

FIG. 17 shows the cross section of yet another example of floor covering according to aspects of the invention. The embodiment shown in FIG. 17 is to a large extent similar to the embodiment shown in FIG. 16, however, no cut (417 in FIG. 16) is provided proximal to the male edge of the panels and extending from the bottom of the panels. The reference numbers in FIG. 17 have the same meaning as the reference numerals in FIG. 16.

Figure 18:
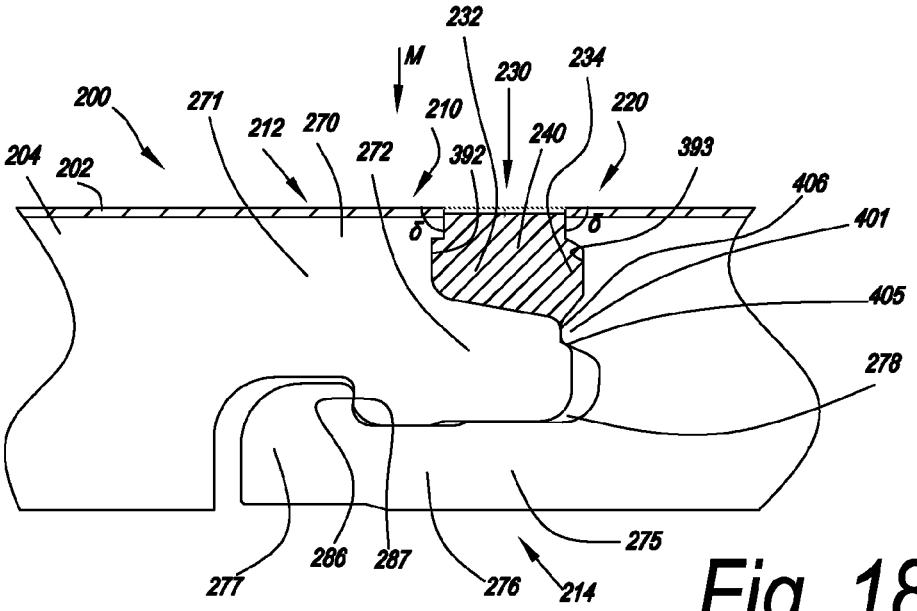

FIG. 18 shows the cross section of yet another example of floor covering according to aspects of the invention. FIG. 18 shows a floor covering comprising floor or wall panels (200). The panels comprise a substrate (204) and a top layer (202). The top layer comprises a decor layer, and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a first recess (234) cut out or otherwise provided at the female edge, through the top layer and extending into the substrate; and a second recess (232) cut out or otherwise provided at the male edge through the top layer and extending into the substrate. The recess (230) comprises a grouting material (240).

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges.

In coupled condition of the male coupling part (212) of a panel with the female coupling part (214) of another panel, a locking in vertical direction is provided at the distal end of the downward-directed locking element (272) of the panel.

A nose (401) extends from the proximal end of the edge comprising the female coupling part. The nose (401) interacts with the downward-direct locking element (272) of the coupled panel, thereby providing a locking in vertical direction at the distal end of the downward-directed locking element (272).

The nose (401) of the first of the coupled panels establishes a first contact surface (405) with the female edge of the second of the coupled panels and a second contact surface (406) with the female edge of the second of the coupled panels. The first contact surface (405) is perpendicular with the surface of the coupled panels, thereby establishing a locking in horizontal direction of the coupled panels.

The second contact surface (406) makes—in the example of FIG. 18—an angle −25° with the surface of the coupled panels.

The grouting material (240) contacts the upper part of the nose (401). Furthermore, the grouting material (240) contacts at least part of the upper surface of the downward-directed locking element (272). The male edge and the female edge comprise each an undercut (392, 393), wherein each of these undercuts comprise grouting material. All these features provide an excellent anchoring of the grouting material in the coupled panels, increasing the strength of the coupling, and the durability of the grout itself in the floor covering.

In the example of FIG. 18, the proximal end of the downward-directed locking element (272) comprises a first inclined contact surface (286). The proximal end of the upward-directed locking element (277) comprises a second inclined contact surface (287). In coupled condition of a first panel at the edge comprising the downward-directed locking element (272), its first inclined contact surface (286) contacts the second inclined contact surface (287) of the panel with which the first panel is coupled at the edge comprising the downward-directed locking element (272); thereby establishing a locking of the coupled panels in vertical direction. The vertical locking is established with pretension. In the example shown in FIG. 17, the contact surface established by the first inclined contact surface (286) and the second inclined contact surface (287) has an angle 5° with the direction perpendicular to the surface of the panels.

In the example of FIG. 18, in coupled condition of the male coupling part (212) of a panel with the female coupling part (214) of another panel, no locking in vertical direction is provided at the distal end of the upward-directed locking element (277).

The configuration shown in FIG. 18 can e.g. be combined with at the other set of opposing edges of the panels a configuration as shown in any of the FIG. 2, 5, 6, 7, 8 or 10. This way, the panels can be coupled by means of the fold-down technique during installation, followed by the application of the grouting material.

Figure 19:
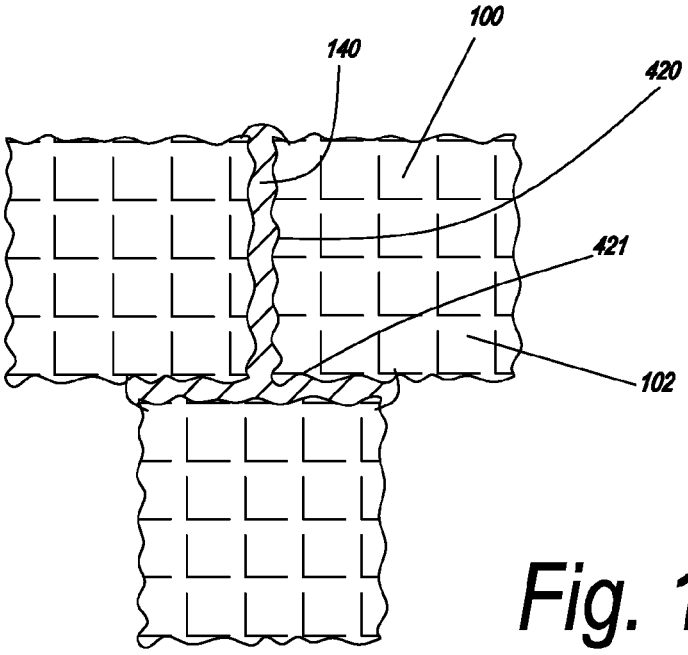
FIG. 19 shows in a view perpendicular to the surface of the covering, a floor covering illustrating aspects of the invention.

FIG. 19 shows in a view perpendicular to the surface of the floor covering, a floor covering illustrating aspects of the invention. The floor covering comprises floor panels (100). The panels are square; and their sides are larger than 250 millimeter, preferably larger than 300 millimeter, more preferably larger than 600 millimeter. However, the panels do not need to be square.

The panels comprise a substrate and a top layer. The top layer comprises a decor layer (102), and optionally a wear layer. The panels are provided at the edges of the first set of opposite sides with coupling parts, cooperating which each other, substantially in the form of male coupling parts and female coupling parts, for coupling the panels to each other in the floor or wall covering. The male coupling part is provided at the male edge of the panels. The female coupling part is provided at the female edge of the panels. The coupling parts are provided with integrated mechanical locking means which prevent the drifting apart of two coupled panels into the direction perpendicular to the surface of the floor or wall covering and into the direction perpendicular to the respective edges in the plane of the floor or wall covering.

The edges of the second set of opposite sides are provided with coupling parts, cooperating which each other, substantially in the form of male coupling parts and female coupling parts, for coupling the panels to each other in the floor or wall covering. The male coupling part of the second set of opposite sides is provided at the male edge of the panels. The female coupling part of the second set of opposite sides is provided at the female edge of the panels. The coupling parts at the second set of opposite sides are provided with integrated mechanical locking means which prevent the drifting apart of two coupled panels into the direction perpendicular to the surface of the floor or wall covering and into the direction perpendicular to the respective edges in the plane of the floor or wall covering.

At one or at both edges of the first set of opposite sides as well as of the second set of opposite sides, a recess is provided at the surface of the floor or wall covering between two panels mechanically coupled to each other by the male coupling part and the female coupling part. These recesses comprise grouting material (140). Grouting material (140) is provided around the full circumference of the decor layer of the panels.

The decor layer (102) ends at the edges of the two opposite provided with coupling parts in the view perpendicular to the surface of the panel along non-linear lines (420, 421). The non-linear lines (420, 421) in the example of FIG. 19 are irregularly undulated lines. However, the use of other types of non-linear lines is possible, e.g. crenated lines; and/or lines comprising notches.

The floor covering shown in FIG. 19 can be a floor covering according to any appropriate embodiment of the first, second, third, fourth or sixth aspect of the invention.

FIGS. 20-26 show details of features that can be used in aspects of the invention. FIG. 20 shows a detail (500) of the floor covering of FIG. 10: the upper side edges of the recess (330)— which comprises grouting material (340)—are provided by surfaces of the male edge and of the female edge that have an included angle (δ) with the top surface of the panel that are substantially equal to 90°.

Figure 21:
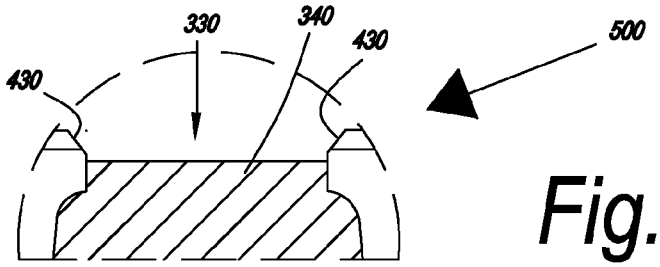

FIG. 21 shows an alternative for the detail (500) that can be used in the invention. the upper side edges of the recess (330)— which comprises grouting material (340)—are provided by surfaces of the male edge and of the female edge that comprise inclined bevels (430).

Figure 22:
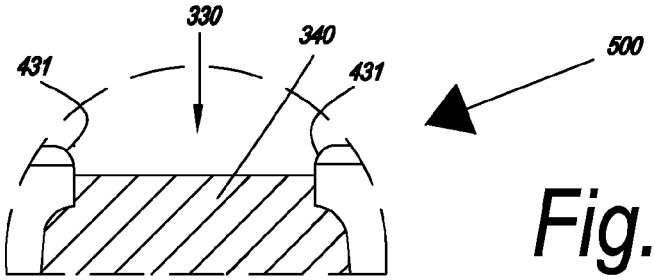

FIG. 22 shows yet another alternative for the detail (500) that can be used in the invention. The upper side edges of the recess (330)— which comprises grouting material (340)— are provided by surfaces of the male edge and of the female edge that comprise curved bevels (431).

Figure 23:
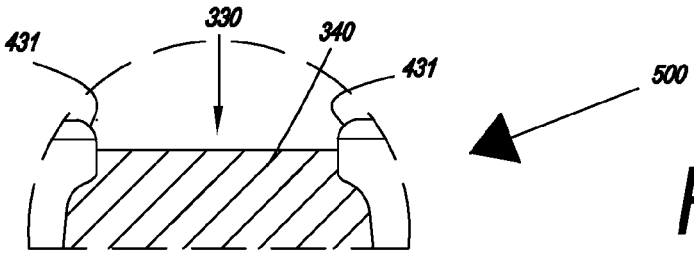

FIG. 23 shows yet another alternative for the detail (500) that can be used in the invention. The upper side edges of the recess (330)— which comprises grouting material (340)— are provided by surfaces of the male edge and of the female edge that comprise curved bevels (431). The side edges of the recess (330) are continuously curved, such that they have no sharp edges with could be weak spots during manufacturing, transport or installation of the panels.

Figure 24:
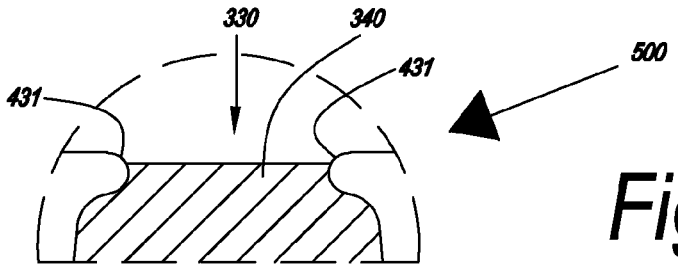

FIG. 24 shows yet another alternative for the detail (500) that can be used in the invention. The upper side edges of the recess (330)— which comprises grouting material (340)— are provided by surfaces of the male edge and of the female edge that comprise curved bevels (431). The side edges of the recess (330) are continuously curved with larger minimum radius of curvature than in the example of FIG. 23, such that they have no sharp edges with could be weak spots during manufacturing, transport or installation of the panels.

Figure 25:
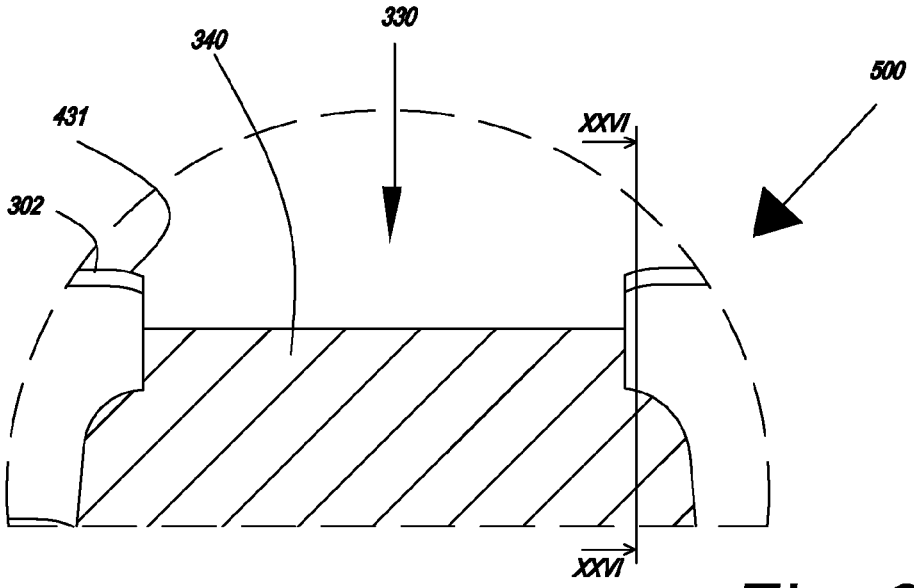

FIG. 25 shows a variant for the detail (500) that can be used in the invention. The panels comprise a substrate (304) and a top layer (302). The top layer comprises a decor layer and optionally a wear layer. The upper side edges of the recess (330)— which comprises grouting material (340)— are provided by surfaces of the male edge and of the female edge that comprise slightly curved bevels (431). The bevels comprise the top layer (302).

Figure 26:
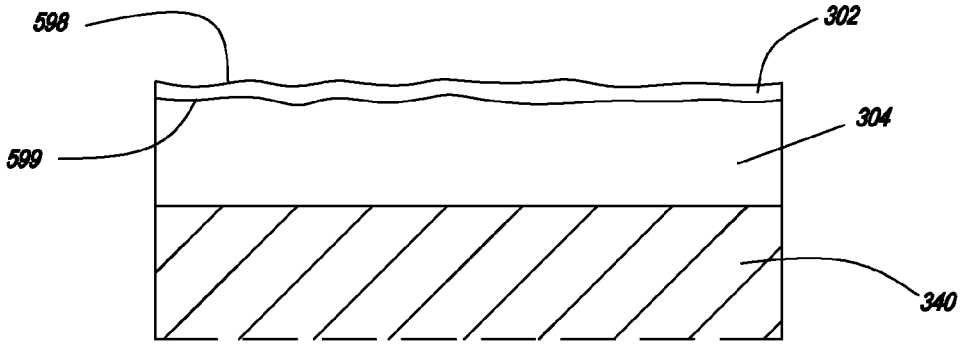

FIG. 26 shows a view according to XXVI-XXVI of the configuration of FIG. 25. The view shows a section through the bevel, perpendicular to the surface of the floor covering and parallel with the edge of the panel where the bevel is provided. FIG. 26 shows the grouting material (340), the substrate (304) and the top layer (302). The surface (598) of the top layer in the bevel—and preferably also the bottom (599) of the top layer in the bevel—has an irregular surface. Such bevels provide a more realistic imitation of a ceramic tile.

The features shown in FIGS. 20-26 can also be implemented in any embodiment of the first, second, third, fourth, fifth and sixth aspect of the invention.

The embodiments illustrated in the drawings show floor coverings and floor panels. In the same way as illustrated for floor coverings and floor panels, the invention relates to wall panels and wall coverings. The difference relates to it that floor panels are installed with the surface of the panels in a horizontal surface; whereas wall panels are installed with their surface parallel with the wall, which is vertical or inclined. The reader will understand how to convert horizontal and vertical directions—as described in the invention and as described in the examples of floor panels and floor coverings shown in the drawings—to wall panels and wall coverings.

Figure 27:
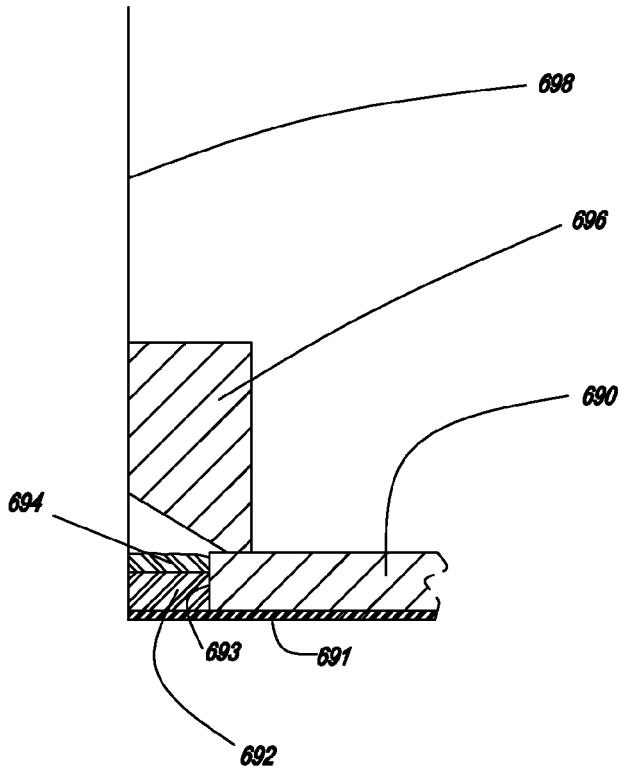
FIG. 27 illustrates an embodiment of a floor covering according to the eighth aspect of the invention.

FIG. 27 illustrates an embodiment of a floor covering according to the eighth aspect of the invention. The floor covering comprises floor panels (690), an elastic strip (692) and a flexible sealing agent (694). The floor panels (691), and in the example also the elastic strip (692), are provided on a subfloor (691). The elastic strip (692) is provided adjacent to and in contact with an edge (693) of the floor covering. The flexible sealing agent (694) is provided on top of the elastic strip (692). The flexible sealing agent (694) is provided adjacent to and in contact with the edge (693) of the floor covering. The elastic strip (692) and the flexible sealing agent (694) are provided between an edge (693) of the floor covering and a wall (698). The flexible sealing agent (694)— and in the example also the elastic strip (692) contact the wall (698). The flexible sealing agent (694) seals the gap between the edge (693) of the floor covering and the wall (698). A skirting board (696) is positioned onto the floor panels providing the edge of the floor covering, and onto the wall (698). The skirting board (696) covers the elastic strip (692) and the flexible sealing agent (694). As an example, the thickness of the floor panel (690) can be 5 mm and the gap between the edge (693) of the floor covering and the wall (698) is 8 mm.

Figure 28:
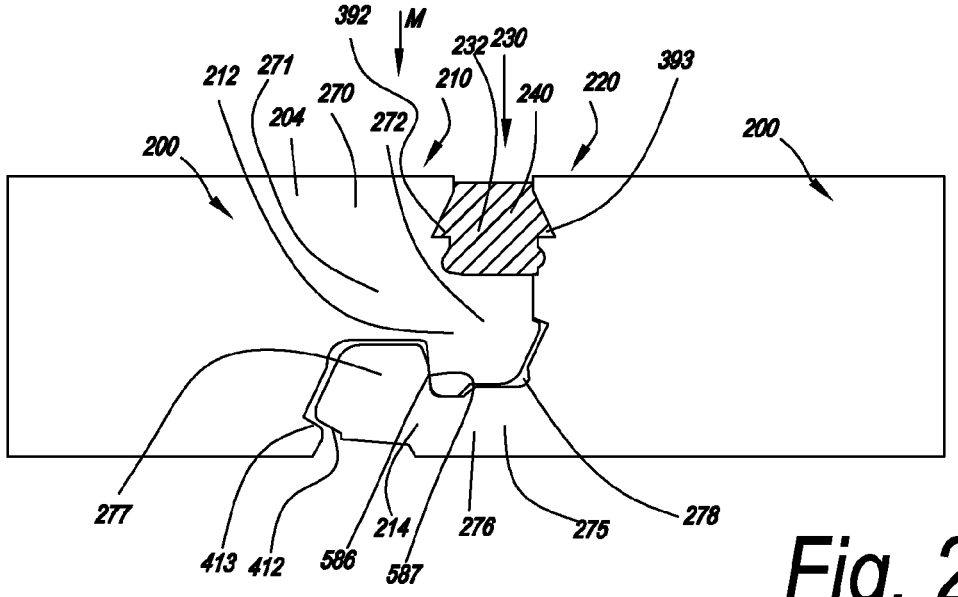
FIGS. 28, 29 and 30 show alternative embodiments of the invention, in cross sectional view similar to FIG. 5.

FIG. 28 shows the cross section of yet another example of floor covering according to aspects of the invention. FIG. 28 shows a floor covering comprising floor or wall panels (200). The panels comprise a substrate (204) and a top layer (not shown in FIG. 28). The top layer comprises a decor layer, and optionally a wear layer. The panels are provided at least at the edges (210, 220) of two opposite sides with coupling parts, cooperating which each other, substantially in the form of male coupling parts (212) and female coupling parts (214), for coupling the panels to each other in the floor or wall covering. The male coupling part (212) is provided at the male edge (210) of the panels. The female coupling part (214) is provided at the female edge (220) of the panels. The coupling parts are provided with integrated mechanical locking means which prevent the drifting apart of two coupled panels into the direction perpendicular to the surface of the floor or wall covering and/or into the direction perpendicular to the respective edges in the plane of the floor or wall covering.

A recess (230) is provided at the surface of the floor or wall covering between two panels mechanically coupled to each other by the male coupling part and the female coupling part. The recess (230) comprises a grouting material (240).

The male coupling part is provided by a downward-directed upper hook-shaped part (270). The downward-directed upper hook-shaped part (270) comprises a lip (271) with a downward-directed locking element (272) which forms a male part.

The female coupling part is provided by an upward-directed lower hook-shaped part (275). The upward-directed lower hook-shaped part (275) comprises a lip (276) with an upward-directed locking element (277), which, proximally thereof, defines a female part in the form of a third recess (278).

The male coupling part and the female coupling part are configured such that two of such panels can be coupled to each other at their respective edges by means of a movement (M) perpendicular to the surface of the panels of the one panel in respect to the other, such that the panels are locked in the plane of the panels and perpendicular to the respective edges.

In coupled condition of the male coupling part (212) of a panel with the female coupling part (214) of another panel, a locking in vertical direction is provided at the distal end of the downward-directed locking element (272) of the panel.

The grouting material (240) contacts part of the upper surface of the downward-directed locking element (272). The male edge and the female edge each comprise an undercut (392, 393), wherein each of these undercuts comprise grouting material (240).

No vertical locking is provided between coupled panels at the proximal end of the upward-directed locking element (277) nor at the proximal end of the downward-directed locking element (272). However, it is preferred when the proximal end of the upward-directed locking element (277) contacts the proximal end of the downward-directed locking element (272) with pretension at their contact surfaces (586, 587).

In coupled condition of the male edge of a panel with the female edge of another panel, a locking in vertical direction is provided at the distal end of the upward-directed locking element (277). The distal end of the upward-directed locking element (277) comprises an undercut (412). The panels comprise at the proximal edge of their male edge a corresponding hook (413). The corresponding hook (413) is provided for interacting with the upward-directed locking element (277) of a coupled panel for establishing a locking in vertical direction.

The bottom surface of the undercut (412) is provided for establishing a locking in vertical direction. In the example shown in FIG. 28, the upward-directed locking element (277) can be locked at the proximal edge of the panel with which it is coupled at the distal end of the upward-directed locking element (277) and wherein the distal end of the upward-directed locking element (277) comprises an undercut (412) and the upward-directed locking element (277) can be locked at the proximal edge of the panel with which it is coupled at the undercut of the upward-directed locking element (277).

This also results in a locking in horizontal direction between neighboring panels provided by contact between coupled panels at the distal end of the downward-directed locking element (277).

The panels of the embodiment shown in FIG. 28 can be installed at their first set of opposite edges via a vertical push movement (M).

Figure 29:
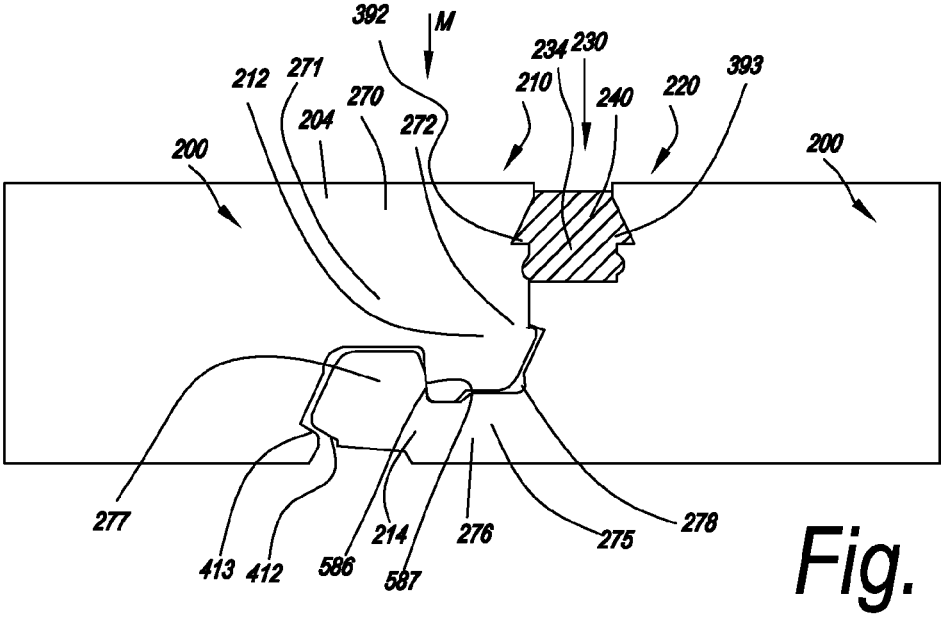
Figure 30:
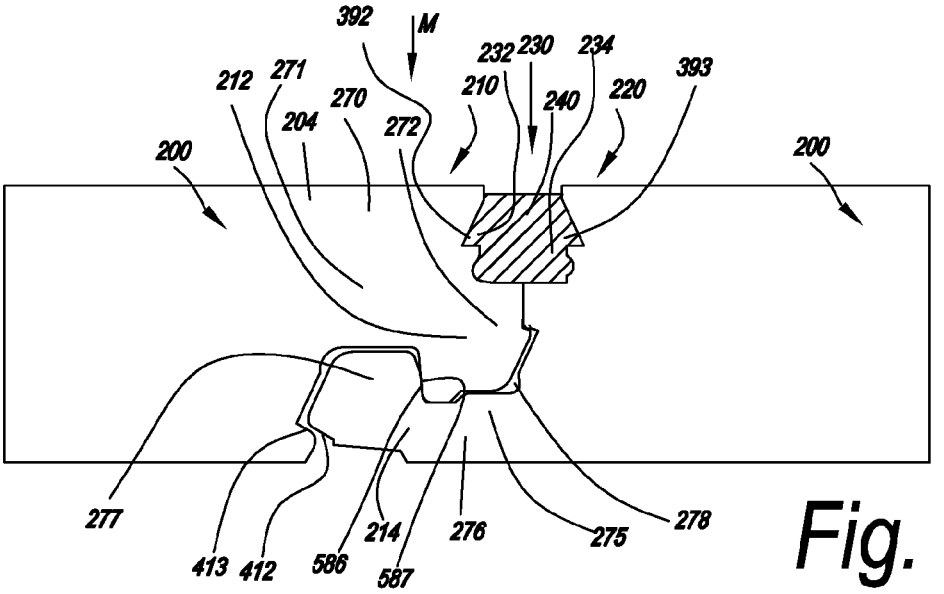

The embodiments of FIGS. 29 and 30 are to a large extend similar to the embodiment of FIG. 28. The difference between FIGS. 28, 29 and 30 is the position of establishment of the recess (230). In the embodiment of FIG. 28, the recess (230) is established by a recess (232) in the male edge of the panel. In the embodiment of FIG. 29, the recess (230) is established as a recess (234) at the female edge of the panels (200). In the embodiment of FIG. 30, the recess (230) comprises a first recess (234) cut out or otherwise provided at the female edge, through the top layer and extending into the substrate; and a second recess (232) cut out or otherwise provided at the male edge through the top layer and extending into the substrate.

The panels shown in the embodiment of FIGS. 28, 29 and 30 can be rectangular, square or oblong. They can be provided at the second set of opposite edges with coupling parts as in any embodiment of any aspect of the invention.

Figure 31:
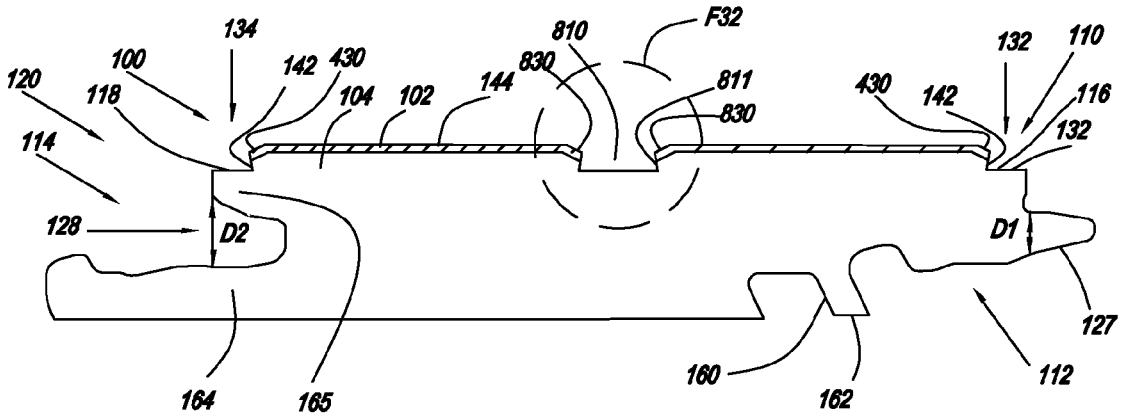
FIG. 31 shows an example of a panel comprising a groove provided between and parallel with the two opposite sides comprising coupling parts.

FIG. 31 shows an example of a panel comprising a groove provided between and parallel with the two opposite sides comprising coupling parts. FIG. 31 shows a panel which is to a very large extent similar to the panel shown in FIG. 1. The reference numerals in FIG. 31 have the same meaning as in FIG. 1. Contrary to the panel shown in FIG. 1, the panel shown in FIG. 31 comprises inclined bevels 430 at its edges 110, 120. The panels comprise on their surface a groove 810, provided between and parallel with the two opposite edges 110, 120 that comprise coupling parts. The groove 810 is provided for receiving grouting material after installation of a plurality of such panels in a covering, e.g. in a floor covering.

The groove 810 of the panel shown in FIG. 31 comprises at both its side surfaces undercuts 811, provided for improved anchoring of grouting material. The width of the upper surface of the groove is dimensioned such that after installation of a plurality of such panels, the upper surface of the groove has substantially the same width as the upper surface of the recess.

Both sides of the groove 810 are provided with inclined bevels 830. The bevels 830 are dimensioned equal to the bevels 430 at the edges of the panels. Although FIG. 31 illustrates inclined bevels, other types of bevels can be provided, preferably wherein the bevels provided at both sides of the groove are substantially similar to the bevels at both edges of the panel. Bevels as described in this document and as shown in the other figures can be used.

The groove 810 is provided in the middle between the recesses at both edges of the pair of opposite edges provided with coupling parts, this way, the groove is positioned such that in a covering the groove will be positioned in the middle between (meaning equidistant from) the recesses at both edges of the panel.

Figure 32:
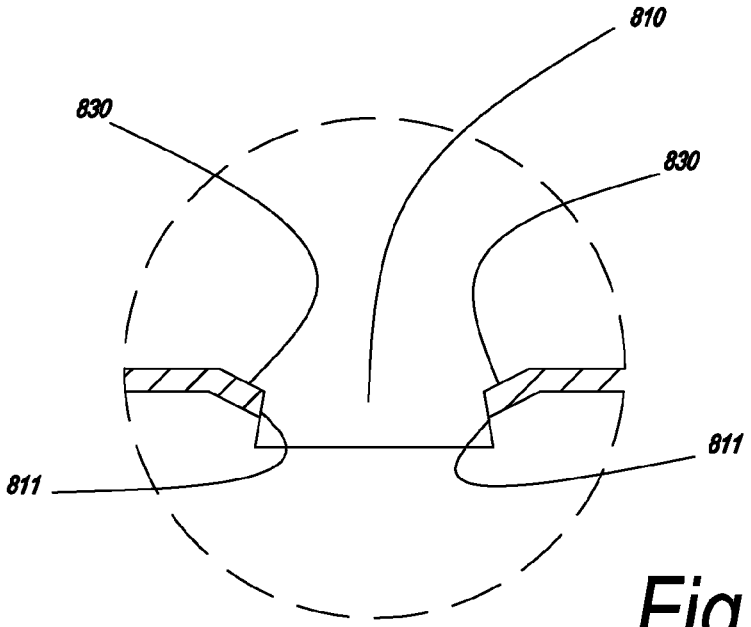
FIG. 32 shows in enlarged representation a detail of the cross section of the groove of FIG. 31.

FIG. 32 shows in enlarged representation a detail F32 of the cross section of the groove of FIG. 31.

Figure 41:
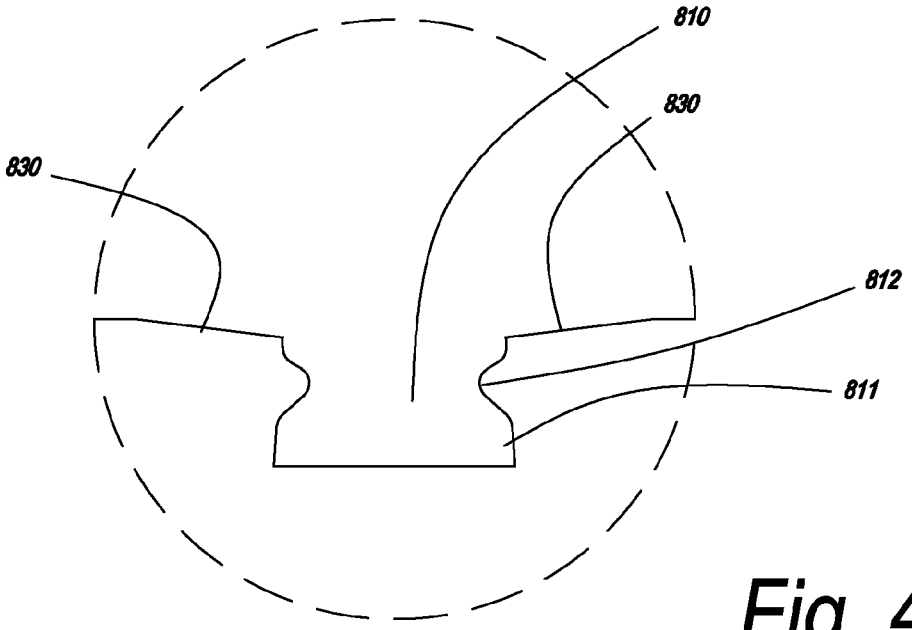

FIGS. 33-41 show in a similar view as FIG. 32 alternative cross sections for grooves 810 provided between and parallel with opposite sides comprising coupling parts. The grooves 810 of FIGS. 33, 34, 35, 37, 38, 39 and 41 comprise undercuts 811. The groove 810 of FIG. 41 is at both sides provided with a protrusin 812 to improve anchoring of grouting material in the groove 810. The grooves of FIGS. 37, 38, 39, 40 and 41 are provided with bevels 830 at both sides. These figures show inclined bevels, however, other types or configurations of bevels can be used as well.

Figure 33:
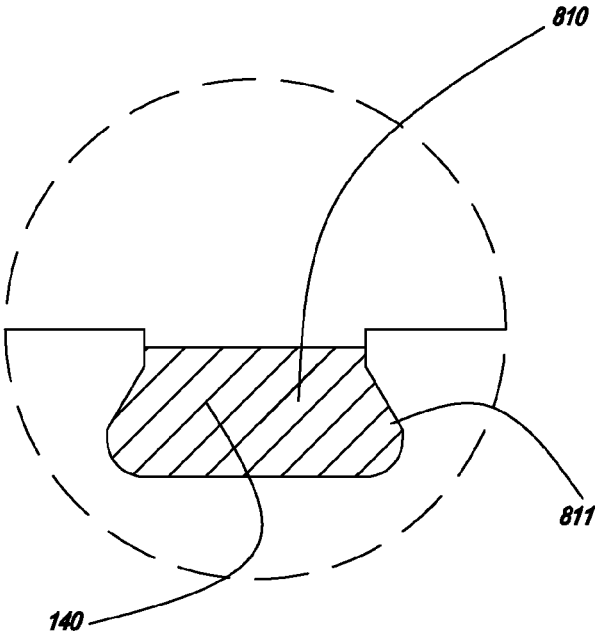
FIGS. 33-41 show in a similar view as FIG. 32 alternative cross sections of grooves provided in panels between and parallel with opposite sides comprising coupling parts.
Figure 34:
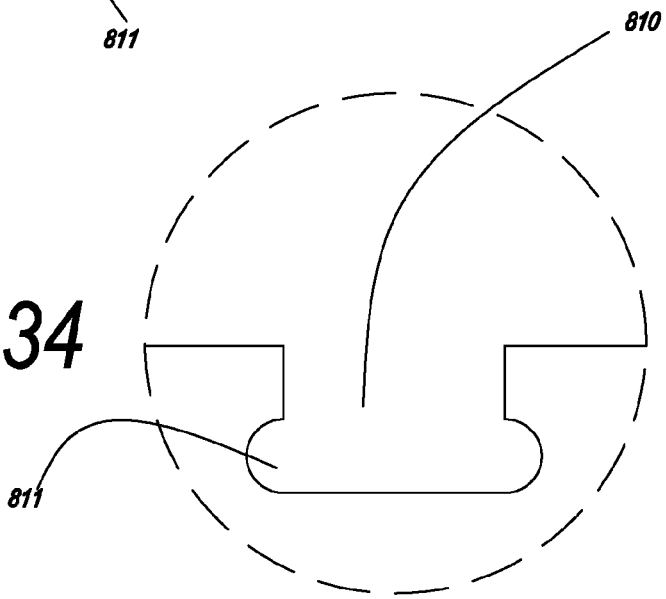
Figure 35:
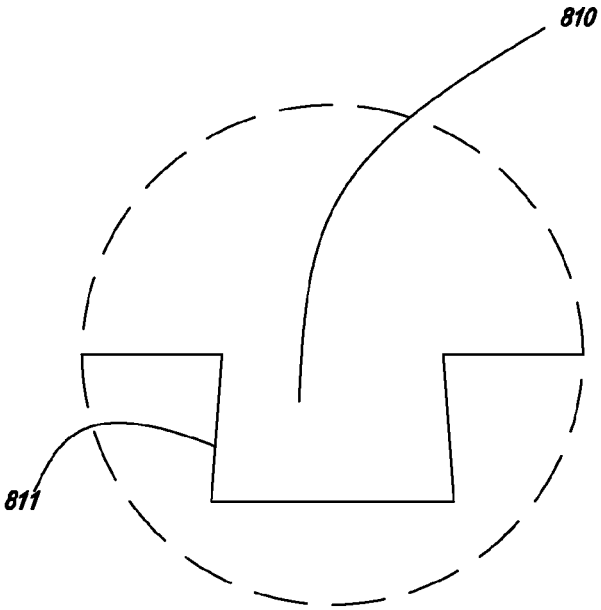
Figure 36:
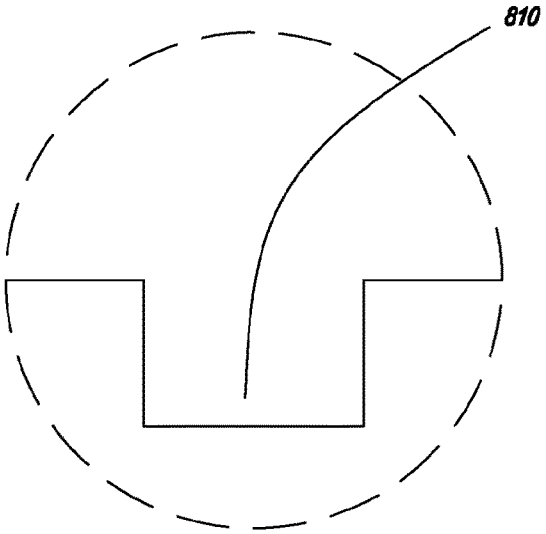
Figure 37:
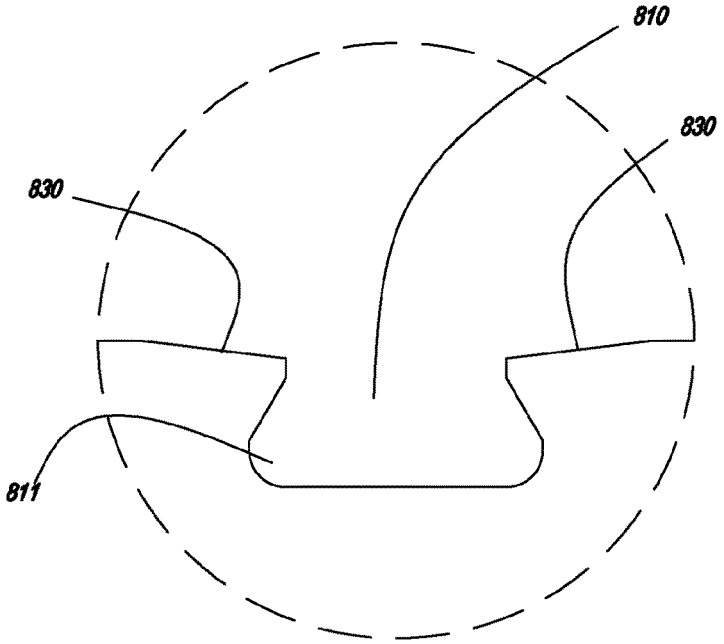
Figure 38:
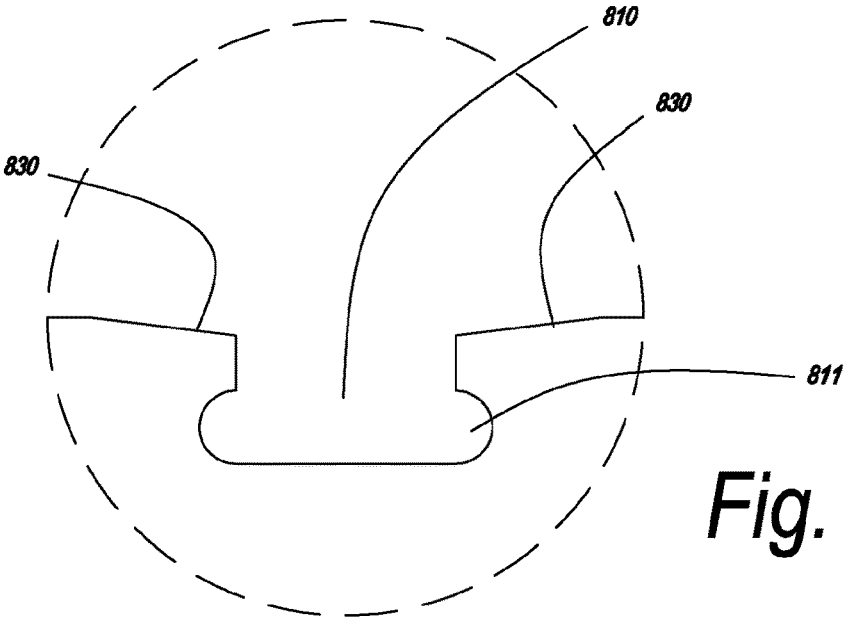
Figure 39:
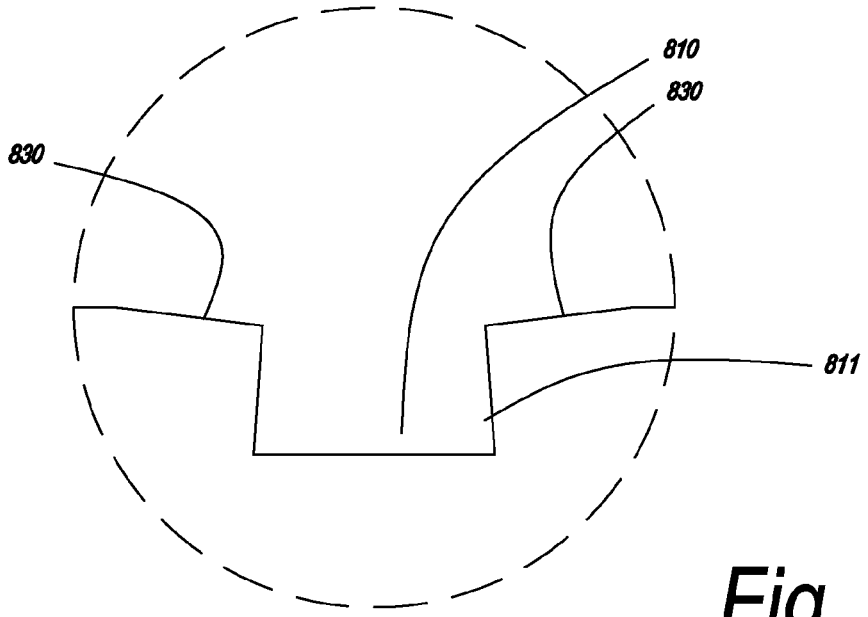
Figure 40:
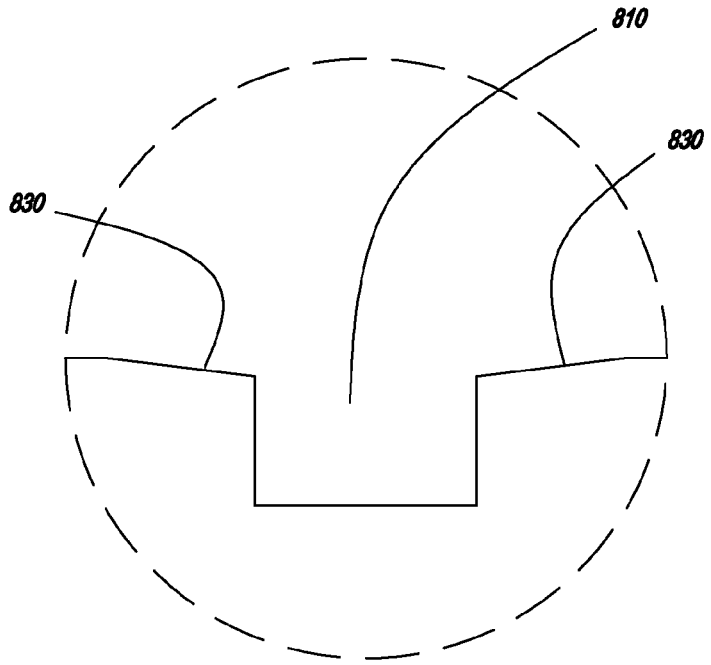

The groove 810 of FIG. 33 is shown comprising grouting material 140; wherein the grooves in the FIGS. 34-41 is shown without grout.

Figure 42:
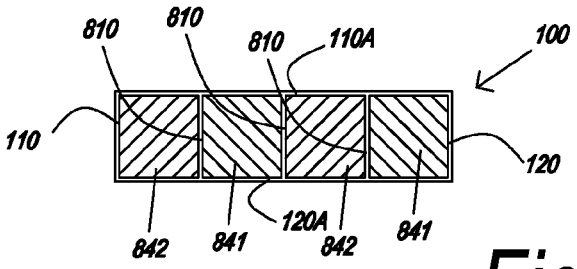
FIGS. 42 and 43 represent panels—viewed from above the panel—comprising grooves produced between and parallel with opposite sides comprising coupling parts.
Figure 43:
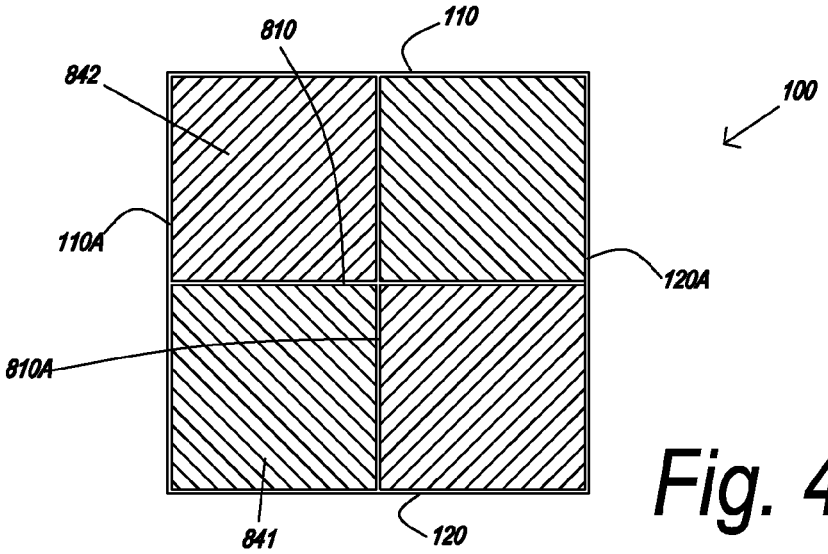

FIGS. 42 and 43 represent panels—in top view—comprising grooves produced between and parallel with opposite sides comprising coupling parts.

The rectangular and oblong panel 100 shown in FIG. 42 is provided at the edges 110, 120 of a first pair of opposite sides with coupling parts, e.g. as represented in other figures. The coupling parts are provided for coupling the panels to each other, e.g. in a floor or a wall covering. The panel is configured, such that after coupling the panels, a recess will be provided at the surface of the floor or wall covering between two panels mechanically coupled to each other at the edges of the first pair of opposite sides. Theses recesses can be grouted with grouting material.

The panel 100 comprises on its surface three grooves 810, between and parallel with the two opposite edges 110, 120 comprising coupling parts. The grooves 810 are located such that they are equidistant with each other and with the recess that will be provided at both edges after coupling panels to each other. The grooves delimit a first decoration pattern 841 from a second decoration pattern 842. However, it is also possible that the full surface of the panel is provided with the same decoration pattern. After installation of the panels, the grooves can be grouted. The length of the panel equals four times its width.

The rectangular and oblong panel 100 of FIG. 42 comprises a second set of opposite sides, wherein the edges 110A, 120A of the second set of opposite sides comprise coupling parts. The coupling parts are provided for coupling two such panels to each other in a floor covering at their second set of opposite sides. The second set of opposite sides are configured such that a recess will provided at the surface of the floor or wall covering between two panels mechanically coupled to each other at the second set of opposite sides. After installation of the panels a grouting material can be provided in these recesses at the second set of opposite sides.

FIG. 43 illustrates an example of a square panel 100. It is provided at the edges 110, 120 of a first pair of opposite sides with coupling parts, e.g. as represented in other figures. The coupling parts are provided for coupling the panels to each other, e.g. in a floor or a wall covering. The panel is configured, such that after coupling the panels, a recess will be provided at the surface of the floor or wall covering between two panels mechanically coupled to each other. Theses recesses can be grouted with grouting material.

The panel 100 comprises on its surface a groove 810, between, parallel with, and equidistant from the two opposite edges 110, 120 comprising coupling parts. After installation of the panels, the groove can be grouted.

The rectangular and oblong panel 100 of FIG. 43 comprises a second set of opposite sides, wherein the edges 110A, 120A of the second set of opposite sides comprise coupling parts. The coupling parts are provided for coupling two such panels to each other in a floor covering at their second set of opposite sides. The edges 110A, 120A of the second set of opposite sides are configured such that a recess will be provided at the surface of the floor or wall covering between two panels mechanically coupled to each other at the second set of opposite sides. After installation of the panels a grouting material can be provided in this recess at the second set of opposite sides.

The panel 100 comprises on its surface a second groove 810A, provided between, parallel with and equidistant between the second set of opposite sides comprising coupling parts. After installation of such panels 100, the second groove 810A can be grouted.

The grooves 810, 810A separate a first decoration pattern 841 from a second decoration pattern 842. However, it is also possible that the full surface of the panel is provided with the same decoration pattern.

Figure 44:
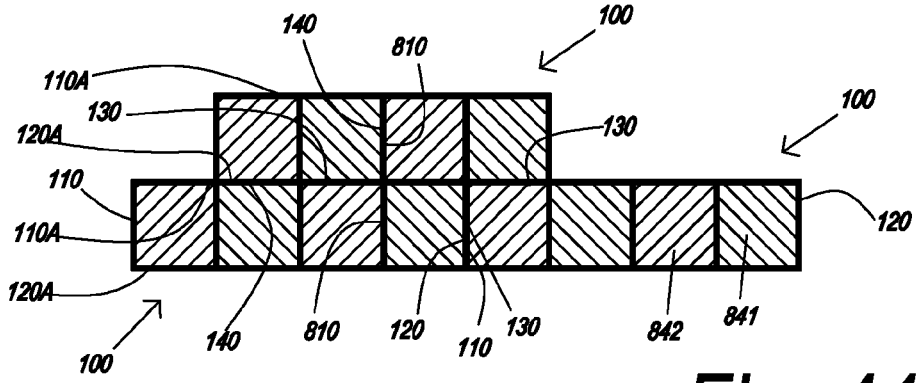
FIG. 44 illustrates a floor covering comprising panels as shown in FIG. 42.

FIG. 44 illustrates a floor covering using panels as shown in FIG. 42. Three panels 100 are shown in this covering. The reference numerals have the same meaning as in FIG. 42. Panels are mechanically coupled at the edges 110, 120 of their first pair of opposite sides, or at the edges 110A, 120A of their second pair of opposite sides.

The recesses 130 at the edges 110, 120 of the first pair of opposite sides, the recesses 130 at the edges 110A, 120A of the second pair of opposite sides, and the grooves 810 have been grouted with the same grouting material 140. The grouting material continues without interruption from grooves 810 to adjoining recesses 130. The panels 100 are configured such that the grooves 810 substantially have the same width as the recesses 130; and such that the recesses 130 in both directions substantially have the same width.

The grooves 810 of a first panel are aligned with the recess of one of the edges of the pair of opposing edges of a neighboring panel with which the first panel is coupled, or the grooves 810 of the first panel are aligned with grooves 810 of a neighboring panel with which the first panel is coupled. This way, the grooves are provided, and aligned to provide a checkerboard panel in the floor covering. The panel 100 of FIG. 42, used in the floor covering of FIG. 44, comprises two different decoration patterns 841, 842, delimited by the grooves 810. However, it is possible that the panel is provided over its full surface with a same decoration pattern. The floor covering of FIG. 44 appears to be laid with four times more panels than the number of panels used in reality.

The present invention is not limited to the embodiments that have been described and/or claimed. Combinations can be made of the embodiments and/or claims, as long as these combinations do not cause contradiction, and while staying within the scope of the invention as defined in the claims.

The invention claimed is:

1. A floor or wall covering comprising floor or wall panels;

the panels comprise a substrate and a top layer;

the top layer comprises a decor layer;

the panels are provided at least at edges of two opposite sides with coupling parts, cooperating which each other, substantially in a form of male coupling parts and female coupling parts, for coupling the panels to each other in the floor or wall covering;

the male coupling part is provided at a male edge of the panels;

the female coupling part is provided at a female edge of the panels;

a recess is provided at a surface of the floor or wall covering between two panels mechanically coupled to each other by the male coupling part and the female coupling part;

wherein the recess comprises a grouting material;

wherein the male coupling parts comprise a tongue;

wherein the female coupling parts comprise a groove;

wherein the groove comprises a bottom lip and an upper lip, wherein the bottom lip extends over a longer distance from the edge of the panel than the upper lip;

wherein the recess comprises a bottom, wherein the bottom is completely provided by part of the upper surface of the tongue;

wherein the part of the upper surface of the tongue provides a complete bottom of the recess, the complete bottom is provided as an inclined plane declining towards a distal end of the tongue;

wherein the female edge comprises a rounded nose above the groove; and wherein the grouting material contacts and adheres to an upper section of the nose and also at least partially to a bottom section of the nose.

2. The floor or wall covering as in claim 1, wherein the recess comprises a first recess provided at the female edge and a second recess provided at the male edge; wherein the second recess comprises a first undercut in the male edge; and wherein the first recess comprises a second undercut in the female edge.

3. The floor or wall covering as in claim 2, wherein the second recess comprises a third undercut in the male edge and/or wherein the first recess comprises a fourth undercut in the female edge.

4. The floor or wall covering as in claim 1, wherein a largest thickness of the tongue is less than 70% of a largest opening of the groove.

5. The floor or wall covering, as in claim 1, wherein the panels are rectangular, square or oblong, wherein a shortest of the sides is larger than 250 millimeters; and, wherein the grouting material is provided around a full circumference of the decor layer of the panels.

6. The floor or wall covering as in claim 1, wherein the top layers of the panels comprise on their upper surfaces another groove;

wherein the another groove of the top layers of the panels also comprises the grouting material.

7. A method for installing the floor or wall covering as in claim 1, the method comprising the steps of:

providing floor or wall panels, for use in a floor or wall covering;

installing the floor or wall panels by mechanically coupling the floor or wall panels by coupling the male coupling parts with the female coupling parts;

applying grout into the recesses provided at the surface of the floor or wall covering between the floor or wall panels mechanically coupled to each other by the male coupling part and the female coupling part.

8. The floor covering, as in claim 1, wherein the floor covering comprises floor panels, an elastic strip and a flexible sealing agent, wherein the elastic strip is provided adjacent to an edge of the floor covering, wherein the flexible sealing agent is provided above the elastic strip, wherein the flexible sealing agent is provided adjacent to and in contact with the edge of the floor covering.

9. The floor covering as in claim 8 wherein a skirting board is positioned onto the floor panels providing the edge of the floor covering, wherein the skirting board covers the elastic strip and the flexible sealing agent.

10. The floor or wall covering as in claim 1, wherein the recess comprises a first recess cut out or provided at the female edge; and a second recess cut out or provided at the male edge.

11. The floor or wall covering as in claim 1, wherein the grouting material is provided on a surface of the male edge substantially parallel with the panel surface and on a surface of the female edge substantially parallel with the panel surface.

12. The floor or wall covering as in claim 1, wherein the coupling parts are configured such that when installing the covering, a panel is arranged to be coupled via a substantially horizontal sliding movement with a snap effect of the panel relative to an already installed panel, wherein the tongue of the panel is arranged to be inserted into the groove of the female edge of the already installed panel with the snap effect.

13. The floor or wall covering of claim 12, wherein a rounding at the bottom of the nose is arranged for the installation and coupling of the panels via the substantially horizontal sliding movement with the snap effect.

14. The floor or wall covering of claim 13, wherein the upper lip comprises the nose, wherein said nose forms the distal end of the upper lip.

15. The floor or wall covering of claim 14, wherein the recess comprises upper side edges provided by surfaces of the male edge and of the female edge, and wherein said nose extends beyond the upper side edge formed by the female edge.

16. The floor or wall covering of claim 15, wherein the upper side edges each have an included angle with the top surface of the panel that is substantially equal to 90°.

17. The floor or wall covering of claim 16, wherein the male and female edges each comprise an undercut located below the respective upper side edges, wherein the undercut at the female edge is located between the nose and the respective upper side edge.

18. A floor or wall covering comprising floor or wall panels;

the panels comprise a substrate and a top layer;

the top layer comprises a decor layer;

the panels are provided at least at edges of two opposite sides with coupling parts, cooperating which each other, substantially in a form of male coupling parts and female coupling parts, for coupling the panels to each other in the floor or wall covering;

the male coupling part is provided at male edge of the panels;

the female coupling part is provided at female edge of the panels;

a recess is provided at a surface of the floor or wall covering between two panels mechanically coupled to each other by the male coupling part and the female coupling part;

wherein the male edge comprises a protrusion directed substantially downwards when the panel is put horizontally, the protrusion is arranged to make contact with a distal end of the other edge, and lock the panels horizontally in a flexible way; a lower end of the protrusion is provided at a same level as a bottom side of the panels;

wherein the male coupling parts comprise a tongue;

wherein the female coupling parts comprise a groove;

wherein a largest thickness of the tongue is less than 70% of a largest opening of the groove.

* * * * *